US010312590B2

(12) United States Patent
Jones, III

(10) Patent No.: US 10,312,590 B2
(45) Date of Patent: Jun. 4, 2019

(54) SMALL UWB ANTENNAS AND METHOD OF DESIGNING THE SAME

(71) Applicant: SPAWAR Systems Center Pacific, San Diego, CA (US)

(72) Inventor: Thomas O Jones, III, San Diego, CA (US)

(73) Assignee: The United States of America as represented by Secretary of the Navy, Washington, DC (US)

( * ) Notice: Subject to any disclaimer, the term of this patent is extended or adjusted under 35 U.S.C. 154(b) by 0 days.

(21) Appl. No.: 15/664,377

(22) Filed: Jul. 31, 2017

(65) Prior Publication Data

US 2019/0036216 A1 Jan. 31, 2019

(51) Int. Cl.

| | |
|---|---|
| ***H01Q 13/02*** | (2006.01) |
| ***H01Q 5/25*** | (2015.01) |
| ***H01Q 1/36*** | (2006.01) |
| ***H01Q 9/32*** | (2006.01) |
| ***H01Q 11/08*** | (2006.01) |

(52) U.S. Cl.

CPC ..... *H01Q 5/25* (2015.01); *H01Q 1/36* (2013.01); *H01Q 9/32* (2013.01); *H01Q 11/08* (2013.01); *H01Q 13/02* (2013.01)

(58) Field of Classification Search

CPC ..... H01Q 5/25; H01Q 13/02; H01Q 13/04; H01Q 19/10; H01Q 13/085; H01Q 1/36; H01Q 9/32; H01Q 11/08; G06F 17/50

See application file for complete search history.

(56) References Cited

U.S. PATENT DOCUMENTS

| | | | | |
|---|---|---|---|---|
| 3,364,491 | A | 1/1968 | Stohr | |
| 5,923,299 | A | 7/1999 | Brown et al. | |
| 7,495,618 | B2 | 2/2009 | Kurashima et al. | |
| 8,121,821 | B1 * | 2/2012 | Jones | G06F 17/5036 703/1 |
| 8,368,156 | B1 * | 2/2013 | Jones, III | G06F 17/5036 257/421 |
| 9,053,268 | B1 * | 6/2015 | Jones, III | G06F 17/5036 |
| 9,223,908 | B2 | 12/2015 | Yamagajo et al. | |

(Continued)

OTHER PUBLICATIONS

John Volakis, Chi-Chih Chen, and Kyohei Fujimoto, "Small Antennas Miniaturization Techniques & Applications" Capter 3, p. 155.

(Continued)

*Primary Examiner* — Hoang V Nguyen

(74) *Attorney, Agent, or Firm* — NIWC Pacific; Kyle Eppele

(57) ABSTRACT

A method is provided for designing an ultra-wide band conical antenna having a bulb shape with a conical feed point having a predetermined input feed resistance. The method includes: choosing a charge distribution cone angle, ψ, for the predetermined input feed resistance; choosing the length of the charge distribution, κ; determining a desired resistance, capacitance and a Q-factor via a quasistatic antenna design algorithm based on ψ and κ; and selecting an ultra-wide band conical antenna design having a bulb shape with a conical feed point, from among the set of ultra-wide band conical antenna designs having a bulb shape with a conical feed point, that produces the desired resistance, capacitance and Q-factor.

20 Claims, 16 Drawing Sheets

(56) References Cited

U.S. PATENT DOCUMENTS

| | | | | |
|---|---|---|---|---|
| 9,252,495 | B1 * | 2/2016 | Jones, III | H01Q 13/085 |
| 9,293,815 | B1 | 3/2016 | Horner et al. | |
| 2010/0066632 | A1 * | 3/2010 | Kurashima | H01Q 1/1207 343/878 |
| 2010/0156743 | A1 * | 6/2010 | Yanagi | H01Q 1/36 343/846 |

OTHER PUBLICATIONS

Ted Simpson, Milos Pavlovic, and Dragan Olcan "Comparing Pulse Radiation from the Unloaded Ice Cream Cone and Resistively Loaded Cone," IEEE 2011.

Takuya Taniguchi, Akihide Maeda, and Takehiko Kobayashi, "Development of an Omni-direction and Low-VSWR Ultra Wideband Antenna", Int'l Journal on Wireless and Optical Communications, vol. 3, No. 2 (2006), pp. 145-157.

* cited by examiner

SMALL UWB ANTENNAS AND METHOD OF DESIGNING THE SAME

FEDERALLY-SPONSORED RESEARCH AND DEVELOPMENT

The United States Government has ownership rights in this invention. Licensing inquiries may be directed to Office of Research and Technical Applications, Space and Naval Warfare Systems Center, Pacific, Code 72120, San Diego, Calif., 92152; telephone (619) 553-5118; email: ssc_pac_t2@navy.mil, referencing NC 102956.

BACKGROUND

Embodiments of the invention relate to methods of designing ultra-wide band (UWB) antennas.

One type of UWB antenna is a UWB conical antenna that is terminated with a shape, for example a sphere or exponential taper, to reduce the reflection from the end of the cone and reduce the lower frequency. This is a cut and try approach. The typical UWB antenna is larger than the ¼ wave monopole antenna. One prior art UWB antenna achieves a 10 to 1 frequency range by adding a helix to a conical antenna. This antenna is limited to a 10 to 1 frequency range.

There exists a need for a method of designing a low Q-factor UWB bulb shaped antenna.

SUMMARY

An aspect of the present invention is drawn to a method for designing an ultra-wide band conical antenna having a bulb shape with a conical feed point having a predetermined input feed resistance. The method includes: choosing a charge distribution cone angle, ψ, for the predetermined input feed resistance; choosing the length of the charge distribution, κ; determining values for two of the following characteristics: resistance, capacitance and Q-factor via a quasistatic antenna design algorithm based on ψ and κ; and selecting an ultra-wide band conical antenna design having a bulb shape with a conical feed point, from among the set of ultra-wide band conical antenna designs having a bulb shape with a conical feed point, that produces the desired resistance, capacitance and Q-factor.

BRIEF SUMMARY OF THE DRAWINGS

The accompanying drawings, which are incorporated in and form a part of the specification, illustrate example embodiments and, together with the description, serve to explain the principles of the invention. In the drawings.

DETAILED DESCRIPTION

Figure 1:
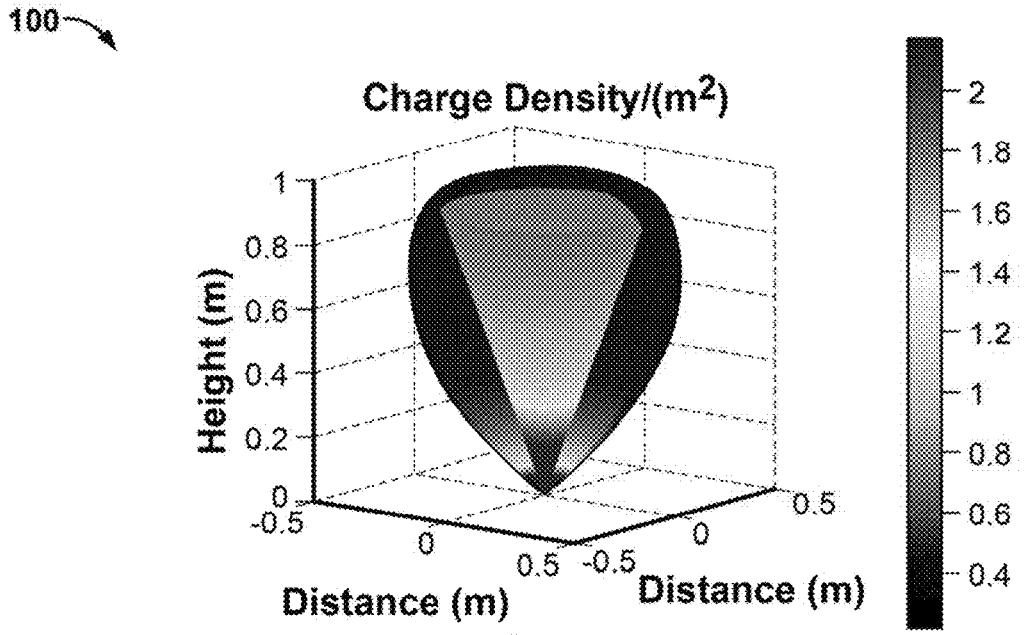
FIG. 1 is a Matlab plot of a 50Ω input impedance UWB antenna with a 120° cutaway showing the conical charge distribution.

The ultra-wide band (UWB) UWB antenna shape determines both the lowest operating frequency and Q-factor ratio. For electrically small antennas, the quasistatic antenna design algorithm can be used to design very low Q-factor ratio antennas with high bandwidth. The Q-factor ratio is the coefficient of the largest term in Chu's limit. Lowering the Q-factor ratio reduces the Q-factor for electrically small part of the frequency range. The UWB antenna shape in the Quasistatic Antenna Design Algorithm (QADA) is a cone with an attached bulb. The lowest operational frequency is reduced without increasing the voltage standing wave ratio (VSWR) at higher frequencies. This is a physics based algorithmic approach that avoids the typical "cut and try method."

A lower bound was established in 1948 for the Q-factor, inverse bandwidth, of an antenna. Chu's limit is calculated from the energy stored in the electromagnetic field. The antenna is enclosed within a sphere with a radius a; only the stored energy outside the sphere is included in the limit. The energy inside the sphere is zero. For top-loaded monopoles, the energy is electrostatic below the antenna's resonant frequency and magnetic above the antenna's resonant frequency. At resonance the electric and magnetic energy are equal but 90° out of phase. The top-loaded monopoles, has a large reactance and stored magnetic energy above resonance. On the other hand, the UWB antennas have small reactance and stored magnetic energy above resonance. In UWB antennas, the Q-factor is ~1 above the lowest operational frequency.

An infinite bi-conical (transmission line) is a UWB antenna with a constant impedance; the cone angle determines the impedance. A finite bi-conical antenna is known, wherein the end of the cone reflects the out-going wave back into the feed point. Thus, the antenna is no longer UWB or constant impedance. Reducing this reflection from the top of the cone is a long standing problem. A tear drop antenna (bi-cone at feed point) has been developed to improve the performance. A volcano and smoke antenna design was an effort to eliminate the reflection from the antenna. The volcano and smoke monopole is typically $\frac{1}{4}^{th}$ a wave length high. Others have used resistive material in the cone to absorb the reflection from the top of the cone; this reduces the antenna efficiency. The Ice Cream Cone (ICC) monopole does not use resistive material. The combined spherical bulb and cone has no reflection from the feed point. The ICC antenna height; is $\frac{1}{5}^{th}$ of the longest operational wavelength. For a 1-m monopole, the lowest operational frequency is 60 MHz. Another approach to the UWB antenna design is the exponential taper and hyperbolic cosine taper, both of which reduce the width of the antenna. This implies that the bulb shape can be non-spherical shapes at high frequencies.

The stored energy in an UWB antenna is analyzed differently. The cone is a transmission line that supports an outgoing freely propagating wave; the outgoing wave does not represent stored energy. The transmission is terminated with a bulb. The bulb reflects some of the RF energy back into the transmission line to the feed point. This reflected energy, an incoming wave, is included in the stored energy and in the Q-factor. The bulb also contributes directly to the stored energy. The bulb shape is the critical factor in determining the Q-factor. For a fixed cone angle, the cone plays no role in the Q-factor.

The present invention provides a low Q-factor UWB bulb shaped antenna, and the method of making the same. An antenna in accordance with aspects of the present invention is significantly smaller than a conventional UWB antenna. An antenna in accordance with aspects of the present invention is $\frac{1}{6}^{th}$ of a wavelength at the lowest frequency, whereas a prior art antenna has monopole that is $\frac{1}{5}^{th}$ of a wavelength at the lowest frequency. An antenna in accordance with aspects of the present invention is 82% the size of such a prior art antenna.

The QADA is used to design a minimum Q-factor bulb shape with a conical feed point. The QADA uses known electrostatic methods. In electrically small antennas, the magnetic fields are small and can be neglected. This permits the use of the quasi-static approximation used in the algorithm. A static charge distribution is used to generate equipotential surfaces. The equipotential surfaces are perfect conductors with $E_{\|}=0$. Each equipotential surface represents a unique antenna surface and surface charge density. For an antenna, the charge is only on the surface of the conductor. The quasi-static antenna design algorithm requires the charge distribution to be enclosed by the equipotential surfaces.

The antenna Q-factor is calculated from radiation resistance, $R_{Rad}$, the capacitance C and the angular frequency $\omega-2\pi f$:

$$Q = \frac{1}{\omega C R_{Rad}} = \frac{Q_{Factor\ ratio}}{(ka)^3} \tag{1}$$

where f is the frequency

The Q-factor ratio, $Q_{Factor\ ratio}$, is calculated from Q, and ka, where $k=2\pi/\lambda$, $\lambda$ is the wavelength and a is the enclosing spheres radius. The radiation resistance is calculated from effective height and the effective height is calculated from charge distribution. The capacitance is calculated from the peak scalar potentials on the enclosing sphere. For a fixed DC voltage V, higher capacitance increases the stored energy $E=CV^2/2$. For a fixed charge Q, increasing the capacitance decreases the stored energy $E=Q^2/(2C)$. The QADA used a fixed charge on the monopole arm. The QADA has been used to compute a thick-disk-cap monopole. The charge disk height and radius describe the geometry of the thick disk charge distribution. The charge distribution on the disk uses 5 unknowns. The thick-disk-cap monopole required only 7 unknowns to converge to the solution. Above thick-disk-cap monopole resonance, this design has 37% lower Q-factor than the spherical-cap monopole design (the best known top-loaded monopole design).

The QADA requires a charge distribution that generates a wide range of cone and bulb shapes. The z-axis line charge distribution used in does not model the general bulb shape. A rotationally symmetric three-dimensional conical charge distribution models the bulb shape and the conical feed point. The conical charge distribution is also selected to simplify the numerical calculation required for the Quasi-static Antenna Design Algorithm. Other rotationally symmetric three-dimensional charge distributions could be used.

FIG. 1 is a Matlab plot of the 50Ω input impedance UWB antenna with a 120° cutaway showing the conical charge distribution.

The gray is the magnitude of the surface charge density/$m^2$ on the antenna and cone. The surface charge density/$m^2$ is smaller on the antenna than the cone. The charge on the antenna is spread over a larger area; this significantly reduces the surface charge density. In addition, the image cone reduces the electric field and surface charge density above the bulb. The image cone increases the electric field and surface charge density near the feed point of the antenna.

The calculation of the effective height for the conical charge distribution will be described herein. The charge distribution is selected to give a very good approximation of a 50Ω cone. This conical charge distribution reduces to a line charge on the z-axis (cone half angle $\psi=0$). The normalized radiation resistance, $R_{Rad}/(ka)^2$ is computed as a function of charge-distribution-cone half angle and fractional cone length (length/a).

A developed numerical method to calculate the scalar potential for the general conical charge distribution will then be described herein. The numerical method uses 2N wires to model the charge distribution. The error in this numerical model is a very small high-order multipole moment in the scalar potential. The high-order multipole moment error decreases with increasing N. The capacitance is computed as a function of charge-distribution-cone half angle and fractional cone length.

A calculation of Q-factor ratio as a function of the charge-distribution-cone half angle and fractional cone length will then be described herein. The Q-factor ratio design curve is discussed in great detail. For a fixed charge-distribution-cone half angle the Q-factor ratio has an absolute and a local minimum. For low-charge distribution-cone half angles, the radiation resistance has a moderate value. At a critical charge distribution-cone half angles, the radiation resistance jumps to a much higher value. At higher charge distribution-cone half angles, the radiation resistance drops, the capacitance increases and the Q-factor ratio drops to a minimum of 3.265. The antenna parameters are calculated for several antenna input impedances 50Ω, 30Ω and the minimum Q-factor antenna; 32Ω. The feed point is a very good approximation of the 50Ω input impedance cone. The 50Ω and 30Ω designs touch the enclosing sphere at the top. The minimum Q-factor antenna, 32Ω, touches the enclosing sphere on the side. The minimum Q-factor antenna, 32Ω input impedance, designed with this simple model does not fill the top of the sphere. A more complex model would fill the top of the sphere would reduce the antenna Q-factor.

A discussion is to be provided regarding CST being used to compute the impedance of the 50Ω and 30Ω input impedance antennas and the minimum Q-factor antenna, 50Ω; where the VSWR is 3:1 at 43.1 MHz, 40.1 MHz and 39.3 MHz, respectively. The VSWR drops very quickly to a VSWR of ~1.2 to 1; then the VSWR is ~1.1 to 1 up to 2.5 GHz.

Three QADA generated UWB non-spherical bulb shapes in accordance with aspects of the present invention will then be described. The non-spherical bulb shape performs as well as the spherical bulb. A more complex conical charge distribution would provide a lower Q-factor design by extending the length of the cone and increase the size of the bulb. Minimizing the Q-factor ratio may increase the VSWR at higher frequencies This could be caused by an edge on the antenna surface. A different antenna design near the minimum Q-factor ratio could give a smoother antenna surface. This would reduce the reflection from the edge without significantly increasing the Q-factor ratio of the antenna.

The conical charge distribution and effective height for a UWB antenna will now be described.

The effective height has been computed for an asymptotic conical dipole (ACD) and a linear charge distribution (LCD); both charge distributions are on the z-axis of the dipole. A linear combination of these two charge distributions can create a conical feed point for a UWB antenna; however, the bulb shape is nearly spherical and similar to the ICC antenna.

A rotationally symmetric conical shaped charge distribution can model both the feed point and bulb shape of the UWB antennas. The surface charge σ(l) is integrated around a ring at position l. The total charge on this ring is defined to be a simple linear function on l.

$$q(l)_{monopole} = (1-\alpha)\left(\frac{1}{\kappa a}\right) + \alpha\left(\frac{2l}{(\kappa a)^2}\right) = \int_0^{2\pi} \rho(l)\sigma(l)d\theta, \tag{2}$$

where κa is the cone length, a is the radius of the enclosing sphere, l is the distance to the ring and ρ is the radius of the ring. The fractional cone length κ is dimensionless, 0<κ<1. The parameter α=0.35 gives a very good approximation of a 50Ω input impedance cone at the feed point. The charge-distribution-cone half angle ψ (measured from the z-axis) and κ the fractional cone length generate a family of UWB antenna designs. For the charge-distribution-cone half angle ψ=0, equation (2) reduces to a linear combination of the ACD and LCD with the charge distribution on the z-axis.

Figure 2:
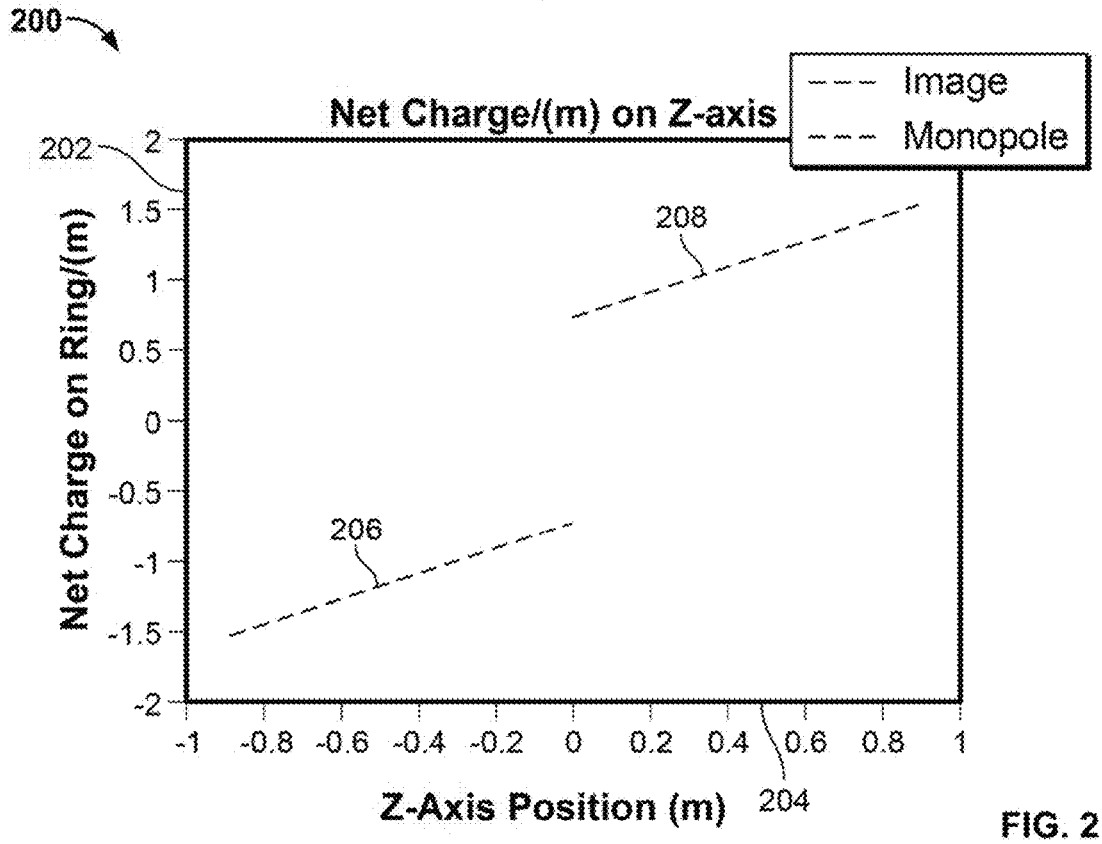
FIG. 2 illustrates charge as a function of z.

The effective height depends only on the projected height of the charge on the z-axis. The radius and height of the ring of charge is ρ=l sin ψ and z=l cos ψ, respectively.

$$q(-l)_{image} = -q(l)_{monopole} \tag{3}$$

the charge as a function of $z$ is $$q(z) = q(z/\cos\psi)/\cos\psi \tag{4}$$

is plotted in FIG. 2. Line 208 is the charge on the monopole and line 206 is the charge on the image monopole.

The surface charge density on the antenna (with a 120° slice removed) and cone is plotted in FIG. 1. The antenna and cone have the same net charge; however, the charge on the antenna is spread out over a larger area. This significantly reduces the surface charge density on the antenna. The image cone also reduces the electric field and surface charge density on the bulb's top. The image cone increases the electric field and surface charge density near the feed point. The surface charge on the cone is:

$$\sigma_s(l) = q(l)/(2\pi\rho). \tag{5}$$

It should be noted that $\rho \to 0$ and $\sigma_s \to \infty$. The net charge on the ring is finite. For display purposes, the range of values plotted is limited to $|\sigma_s| \leq 10 \min(|\sigma_s|)$.

The charge distribution on the monopole arm is normalized to give.

$$q_{Total} = \int_0^{\kappa a} q(l)dl = 1 \tag{6}$$

The effective height is easily calculated as $$h_{Eff} = \frac{1}{q_{Total}} \int_0^{\kappa a} q(l)z dl = \frac{1}{q_{Total}} \int_0^{\kappa a \cos\psi} \frac{q(z/\cos\psi)}{\cos\psi} z dz. \tag{7}$$

This reduces to:

$$h_{Eff}(\kappa, \psi) = \left[(1-\alpha)\frac{\kappa a}{2} + \alpha\frac{2\kappa a}{3}\right]\cos\psi. \tag{8}$$

The radiation resistance is calculated from the standard equation $$R_{Rad}(\kappa,\psi) = 40k^2 h_{Eff}^2, \tag{9}$$

where k=2π/λ and λ is the wavelength.

Figure 3:
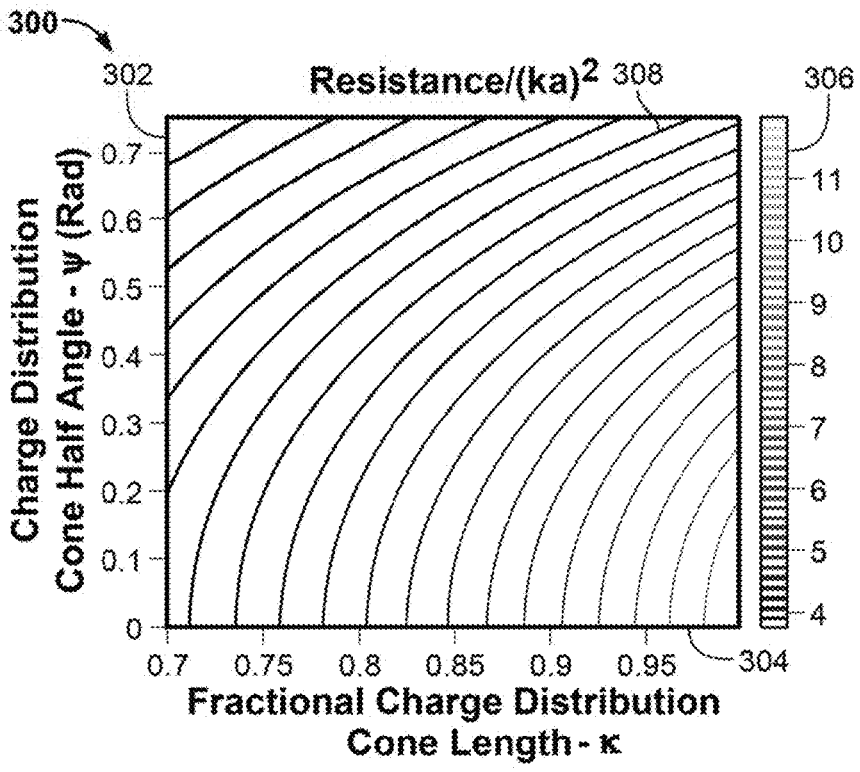
FIG. 3 is a plot of $R_{Rad}(\kappa,\psi)*(ka)^2$ as a function of the cone geometry ψ and κ.

FIG. 3 is a plot of $R_{Rad}(\kappa,\psi)/(ka)^2$ as a function of the cone geometry ψ and κ.

The $R_{Rad}(\kappa,\psi)/(ka)^2$ is independent of frequency and the enclosing sphere's radius a.

The capacitance for the UWB antenna design will now be described.

The capacitance is computed from the net charge on the dipole arm and the maximum scalar potential on the enclosing sphere. The scalar potential for the cone charge distribution is rotationally symmetric (z,ρ), where ρ is the radial distance from the z-axis and z is the position on the z-axis. The rotationally symmetry reduces the scalar potential calculation to the x-z plane.

The cone-charge-distribution scalar potential is computed by replacing the cone's surface with 2N wires running from the charge distribution bi-cone's bottom edge to the charge distribution bi-cone's top edge.

Figure 4:
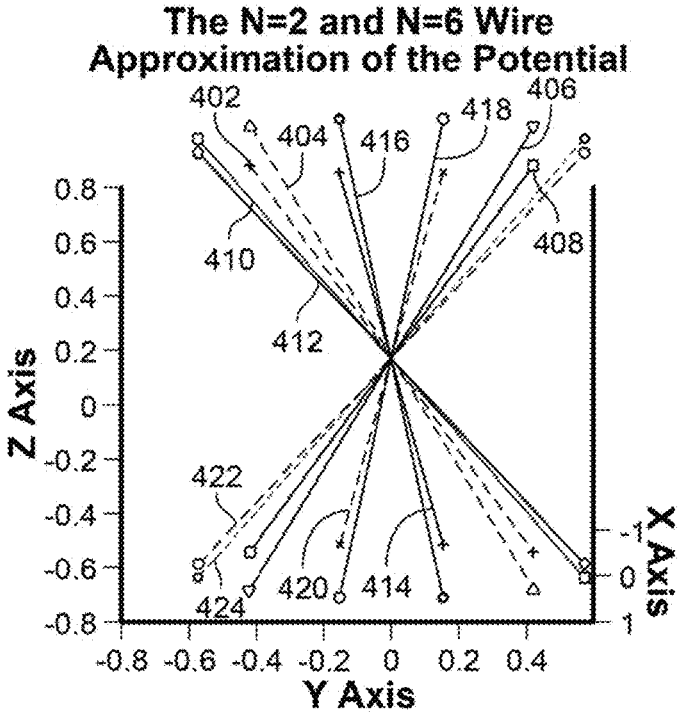
FIG. 4 shows how wires are used to approximate the conical charge distribution, N=2 and N=6.

FIG. 4 shows how wires are used to approximate the conical charge distribution, N=2 and N=6. Lines 402, 404, 406 and 408 represents the N=2 wire approximation, and are symmetric about the x-z plane. The N=6 wire approximation uses the N=2 results. Lines 410, 412, 414, 416, 418, 420, 422 and 424 represent the eight additional wires required for the N=6 wire approximation, and are also symmetric about the x-z plane. Only half of the wires are needed in the numerical method. The cylindrical version of this numerical approximation is known to those of skill in the art; the sequence of wire approximations N, 3N, 9N, . . . , $3^m$N, etc., reuses all of the previous calculations.

Those of skill in the art have computed the scalar potential for the asymptotic conical dipole (ACD) (a constant line and image charge on the z-axis). The following equation includes the image monopole:

$$\Phi^{ACD}(z,\rho)=\frac{1}{4\pi\varepsilon_0\kappa a}\ln\left[\frac{(1+\delta_m)(1-\delta_i)}{(1-\delta_m)(1+\delta_i)}\right], \tag{10}$$

where $\delta_m=\kappa a/(R_f+R_t)$ is for the monopole and $\delta_1=\kappa a/(R_f+R_b)$ is for the image monopole with a unit net charge is on each arm. In this case, the quantities $R_t$, $R_f$ and $R_b$ are the distance from the field point (z, ρ), to the top of the wire, feed point and the bottom of the wire, respectively. Those of skill in the art have calculated scalar potential for the linear charge distribution (LCD) on the z-axis, $2P_1(z'/\kappa a)/(\kappa a)$, $$\Phi^{LCD}(z,\rho)=\int_{-\kappa a}^{\kappa a}\frac{2P_1(z'/\kappa a)}{\kappa a\sqrt{(z'-z)^2+\rho^2}}dz'=\frac{2z}{(\kappa a)^2}\left[\ln\left(\frac{1+\tau}{1-\tau}\right)-2\tau\right], \tag{11}$$

where $\tau=2\kappa a/(R_t+R_b)$, z' is z-axis integration variable for the charge distribution and the net charge on the arm is $$1=\frac{2}{\kappa a}\int_0^{\kappa a}P_1(z'/\kappa a)dz'. \tag{12}$$

The next step is to compute $R_t$, $R_f$ and $R_b$ for the wires on the cone. The wire is rotated ϕ radians around the z-axis; ϕ=0 is on the x-z plane. The cone half angle is ψ radians from the z-axis. The wire end point at the top cone edge is $$z_t=a\kappa\cos\psi$$

$$y_t=a\kappa\sin\psi\sin\varphi$$

$$x_t=a\kappa\sin\psi\cos\varphi. \tag{13}$$

The same wire end point on the bottom cone edge is:

$$z_b=a\kappa\cos\psi$$

$$y_b=a\kappa\sin\psi\sin\varphi$$

$$x_b=a\kappa\sin\psi\cos\varphi. \tag{14}$$

The distance from the top cone edge to the point (z, ρ) (in the x-z plane) is:

$$R_t(\varphi)=\sqrt{[z-\kappa a\cos\psi]^2+[\rho-a\kappa\sin\psi\cos\varphi]^2+[a\kappa\sin\psi\sin\varphi]^2}. \tag{15}$$

The distance from ρ, z (in the x-z plane) to the feed point of the monopole is:

$$R_f=\sqrt{z^2+\rho^2}. \tag{16}$$

The distance from ρ, z (in the x-z plane) to the bottom cone edge (image monopole) is:

$$R_b(\varphi)=\sqrt{[z+\kappa a\cos\psi]^2+[\rho+a\kappa\sin\psi\cos\varphi]^2+[a\kappa\sin\psi\sin\varphi]^2}. \tag{17}$$

The variable $\delta_m(\phi)=\kappa a/[R_t(\phi)+R_f]$ is for the monopole and $\delta_i(\phi)=\kappa a/[R_b(\phi)+R_f]$ is for the image monopole. For the N wire case, $$\varphi_j=(j-\tfrac{1}{2})\pi/N \text{ with } 1\le j\le N. \tag{18}$$

The scalar potential is $$\Phi_N^{ACD}(z,\rho)=\frac{1}{4\pi\varepsilon_0\kappa a}\sum_{j=1}^{j=N}\frac{1}{N}\ln\left[\frac{[1+\delta_m(\varphi_j)][1-\delta_i(\varphi_j)]}{[1-\delta_m(\varphi_j)][1+\delta_i(\varphi_j)]}\right]. \tag{19}$$

The wires with $\phi_i=-(j-\tfrac{1}{2})\pi/N$ give the exact same equation as above and are not included in the calculation.

The LCD scalar potential, equation (10), assumes the line charge is on the z-axis with a unit vector $z_j=1$, $x_j=0$ and $y_j=0$. The dot product of the unit vector and the field position is z. For the cone case, the unit vector for the wire in direction $\phi_j$ and ψ is $z_j=\cos\psi$, $x_j=\sin\psi\cos\phi_j$ and $y_j=\sin\psi\sin\phi_j$. The field position is z, x=ρ and y=0.

The projection $Z_j$ of the field position on the $\phi_j$ wire is calculated with the dot product:

$$Z_j=z\cos\psi+\rho\sin\psi\cos\varphi_j. \tag{20}$$

The scalar potential is:

$$\Phi_N^{LCD}(z,\rho)=\frac{1}{4\pi\varepsilon_0}\frac{2}{(\kappa a)^2}\sum_{j=1}^{j=N}\frac{Z_j}{N}\left[\ln\left(\frac{1+\tau(\varphi_j)}{1-\tau(\varphi_j)}\right)-2\tau(\varphi_j)\right]. \tag{21}$$

In the general case, the error in the N wire numerical approximation is:

$$\Phi_N^{Error}(z,\rho)=|\Phi_{3N}(z,\rho)-\Phi_N(z,\rho)|. \tag{22}$$

The $\Phi_{3N}(z,\rho)$ includes the wires from $\Phi_N(z,\rho)$ plus two more wires on either side of the N wires. The numerical method error $\Phi^{Error}_N(z,\rho)$ is calculated to give $\Phi^{Error}_N(z,\rho)/|\Phi_{3N}(z,\rho)|\le 10^{-7}$. The exact error $\Phi^{Error}_N(z,\rho)$ can only be evaluated after $\Phi_{9N}(z,\rho)$ is computed; however, the error:

$$\Phi_{3N}^{Error}(z,\rho)<<\Phi_N^{Error}(z,\rho) \tag{23}$$

is much smaller. The leading error term can be deduced by symmetry and spherical harmonics.

The scalar potential and cone are both rotationally symmetric; however, the error in the solution has the same rotational symmetry of the 2N wire numerical approximation. The error is found with the spherical harmonic expansion of $\Phi_N(\theta,\phi)$. The wires are equally spaced with $\Delta\phi=\pi/N$ steps in rotational angle and they are odd in z.

The spherical harmonic term, $$Y_{lm}=\sqrt{2l+1(l-m)!/4\pi(l+m)!}P_l^m(\cos\theta)e^{jm\phi}, \tag{24}$$

contributes to the expansion only if it has the same rotational symmetry as the wires m=0, 2N, 4N, etc. It should be noted that $m\Delta\phi=2N*\pi/N=2\pi$. The associated Legendre polynomials must be odd $$P_l^m(\cos\theta)=P_l^m(\cos(\pi-\theta)); \tag{25}$$

this limits l to odd values. The solution is the rotational symmetric part with no $e^{jm\Phi}$ dependence; the only spherical harmonic expansions contributing to the solution are $Y_{2p+1,0}/r^{2p+2}$, where $0 \le p \le \infty$. The first error term in the spherical harmonic expansion is $Y_{2N+1,2N}/r^{2N+2}$. This term is rotationally symmetric in $\pi/N$ steps and odd in z. The first error term in the spherical harmonic expansion of $\Phi_{3N}(z,\rho)$ is $Y_{6N+1,6N}/r^{6N+2}$. At large distances, the largest error is proportional to $$\Phi_N^{Error}(z,\rho) \propto |Y_{2N+1,2N}/r^{2N+2}|. \tag{26}$$

This numerical method converges very fast with the sequence N, 3N, 9N, etc.

The ACD and LCD scalar potentials are combined with the coefficients from equation (2):

$$\Phi_N^{UWB}(z,\rho)=(1-\alpha)\Phi_N^{ACD}(z,\rho)+\alpha\Phi_N^{LCD}(z,\rho). \tag{27}$$

The capacitance is computed from $$\Phi_{Max}^{UWB}(\kappa,\psi)=\max[\Phi_N^{UWB}(z_{Sphere},\rho_{Sphere})]. \tag{28}$$

where $z_{sphere}$=a cos θ, $\rho_{sphere}$=a sin θ and θ are measured from the z-axis and $0 \le \theta \le \pi/2$. The capacitance is $$C^{UWD}(\kappa,\psi)=q_{Total}/\Phi_{Max}^{UWB}(\kappa,\psi). \tag{29}$$

It should be noted that the charge distribution is defined to give $q_{Total}=1$.

In the general case, the odd Legendre Polynomial terms discussed above would modify the potentials of the enclosing sphere and the total charge on the dipole arm $$q_{Total} = 1 + \sum_{m=1}^{m=M} \beta_m \int_0^{\kappa a} P_{2m+1}\left(\frac{l}{\kappa a}\right)\frac{dl}{\kappa a}. \tag{30}$$

$$q_{Total} = 1 - \frac{\beta_1}{8} + \frac{\beta_2}{16} - \frac{5\beta_3}{128} + \frac{7\beta_4}{256} - . \tag{31}$$

$$\Phi_N^{2m+1}(z,\rho) = \frac{1}{4\pi\varepsilon_0}\frac{2}{(\kappa a)^2}\sum_{j=1}^{j=N}\frac{1}{N}\Psi_{2m+1} \tag{32}$$

$$\Psi_m = \int_{-\kappa a}^{\kappa a} \frac{P_m(l/\kappa a)}{\sqrt{(z-l)^2+\rho^2}}$$

where those of skill in the art may compute the potential $\psi_{2m+1}$ for a $P_{2m+1}$ charge distribution as $$\Phi_N^{UWB}(z,\rho) = (1-\alpha)\Phi_N^{ACD}(z,\rho) + \alpha\Phi_N^{LCD}(z,\rho) + \sum_{m=1}^{n=M}\beta_m\Phi_N^{2m+1}(z,\rho) \tag{33}$$

Equation 7 and 29 are unchanged, the value $q_{Total}$ is given by equation 31.

The most general polynomial charge distribution uses all of Legerdre polynomials $$q(l) = \frac{1}{\kappa a} + \sum_{m=1}^{m=M}\eta_m P_m\left(\frac{2l}{\kappa a}-1\right)\frac{1}{\kappa a}.$$

$$q_{Total} = 1 + \sum_{m=1}^{m=M}\eta_m \int_0^{\kappa a} P_m\left(\frac{2l}{\kappa a}-1\right)\frac{dl}{\kappa a}.$$

In this case, the $q_{Total}=1$ is not changed by adding the extra charge distribution terms.

$$h_{Eff} = \frac{1}{q_{Total}}\int_0^{\kappa a} q(l)zdl = \frac{1}{q_{Total}}\int_0^{\kappa a\cos\Psi}\frac{\left[\frac{1}{\kappa a}+\frac{\eta_1}{\kappa a}P_1\left(\frac{2z}{a\kappa\cos(\psi)}-1\right)\right]}{\cos\Psi}zdz$$

In this case, the higher order Legendre polynomials do not contribute to the effective height.

$$h_{Eff} = \frac{ka\cos(\psi)}{2} + \frac{\eta_1 ka\cos(\psi)}{6}$$

The potential is the sum of the top cone and the image cone.

$$\Phi_M^{UWB} = \Phi_N^{ACD} + \sum_{m=1}^{M}\eta_m\Upsilon_N^m + \text{Image}$$

$$\text{Image} = -\Phi_0^{ACD} + \sum_{m=1}^{M}(-1)^{N+1}\eta_m\Upsilon_N^m$$

Where M is the number of higher order Legendre polynomials and N is the number of wires used to numerical calculate the potential.

$$Y_N^m(z,\rho) = \sum_{j=1}^{N}\int_0^{\kappa a}\frac{P_m\left(\frac{2l}{a\kappa}-1\right)}{\sqrt{(z_j-l)^2+\rho_j^2}}dl$$

Where $\rho_j$ is the radial distance from the $j^{th}$ wire and $z_j$ is measured along the axis of the $j^{th}$ wire with $z_j=0$ at the midpoint of the wire. The potential for each wire is a solution the Laplace's problate spherical coordinates; a recursion relation can be used to compute the potential on each wire. In the general case, the $\eta_1$, $\eta_2$ throught $\eta_M$ coefficients are selected to give a good approximation of the feed point cone. The cone shape is computed from a range of coefficients values; the cone shape with a smallest error is selected. This identifies the coefficients for the antenna design. This process allows antennas with higher effective height and radiation resistance to be designed. At any given frequencies, the radiation resistance will higher and closer to the UWB radiation resistance. This reduces the lowest operating frequency of the UWB antenna.

The capacitance is combined with the radiation resistance to compute the Q.

Figure 5:
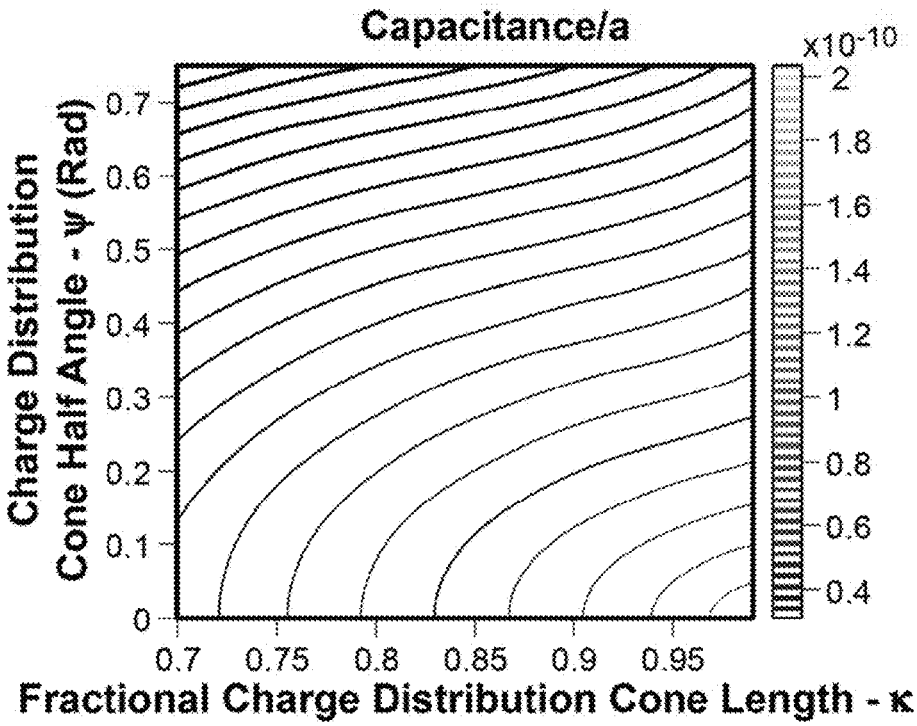
FIG. 5 is the capacitance/a as a function of the cone geometry ψ and κ.

FIG. 5 is the capacitance/a as a function of the cone geometry ψ and κ. The capacitance is scaled by 1/a to make the design curve independent of the enclosing spheres radius a. For a fixed ψ, increasing κ moves the charge distribution cone closer to the enclosing sphere; this increases the peak scalar potential and decreases capacitance. For a fixed κ, the larger half cone angle ψ increases the distance between the enclosing sphere and the charge distribution on the cone. This decreases the peak scalar potential on the enclosing sphere. The negative charge on the image cone is also closer to the top part of the enclosing sphere; this also reduces the peak scalar potential. The peak scalar potential on the enclosing sphere is significantly reduced for the higher half cone angles; this increases the capacitance. In FIG. 5, the distance between contours is smaller for the larger values of ψ.

The UWB antenna Q-factor ratio will now be described.

The capacitance and radiation resistance are combined to compute the Q-factor ratio as a function of fractional charge distribution cone length κ and charge distribution cone half angle ψ. Only a subset of solutions representing an antenna with a conical feed point will be considered. Other solutions with non-conical feed points may not be UWB. The value α=0.35 is selected for the 50Ω input impedance antenna design; it is a good approximation of the feed point cone for all κ and ψ values. The accuracy of the feed point cone is critical to the calculation of the capacitance /a, radiation resistance/$(ka)^2$, and Q-factor ratio. In the following plots, the antenna design curves are independent of frequency and enclosing sphere's radius a. The Q-factor ratio is valid in the limit as frequencies f→0.

Figure 6:
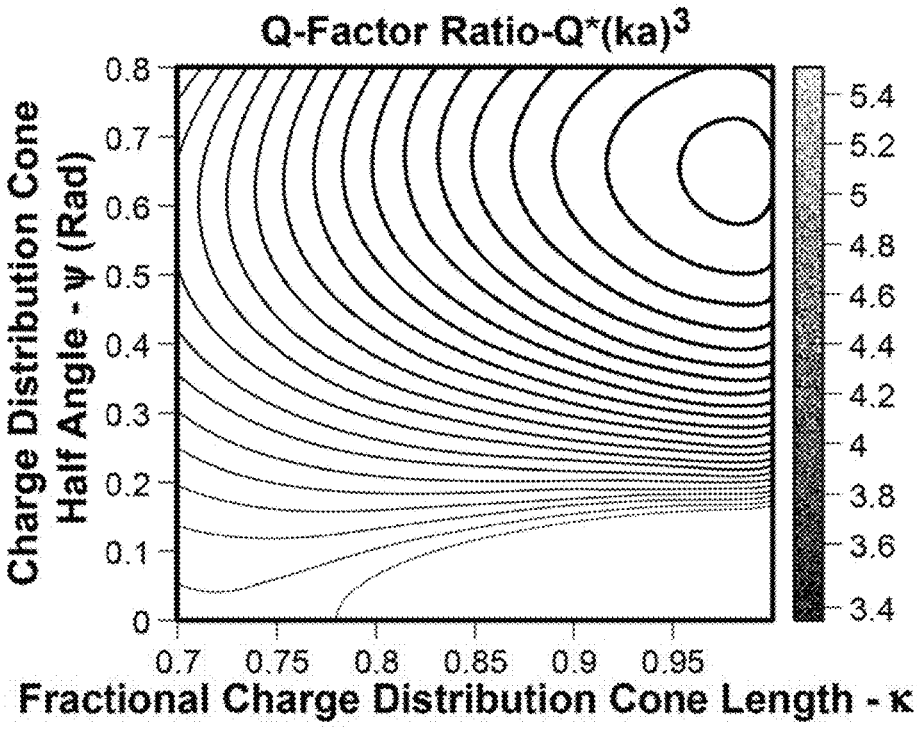
FIG. 6 plots Q-factor ratio, $Q(ka)^3$, as a function of the cone geometry κ and ψ.
Figure 7:
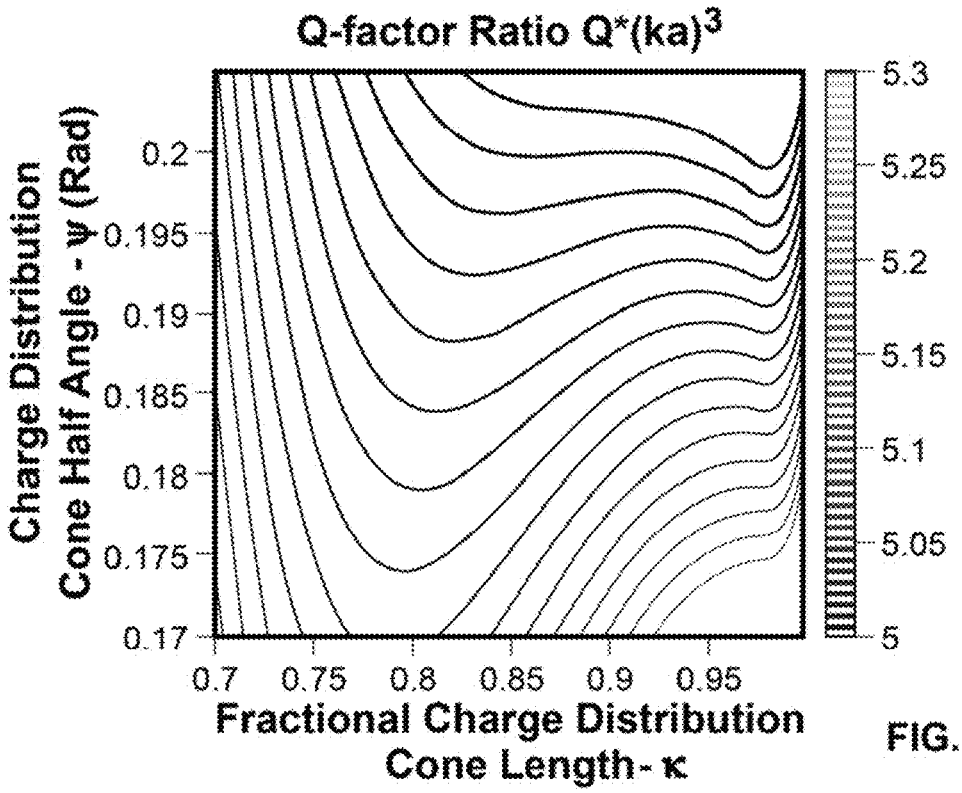
FIG. 7 illustrates an expanded transition region of Q-factor ratio, $Q(ka)^3$, as a function of the cone geometry κ and ψ.

FIG. 6 plots Q-factor ratio, $Q(ka)^3$, as a function of the cone geometry κ and ψ. For small ψ, the minimum Q-factor ratio has moderate κ values. For large ψ the Q-factor ratio has high κ values. The transition region is expanded in FIG. 7; there is an absolute minimum and a local minimum for some values of ψ. The absolute and a local minimum are the same at ψ=0.19481; the absolute minimum shifts from κ~0.84 to κ~0.98.

Figure 8:
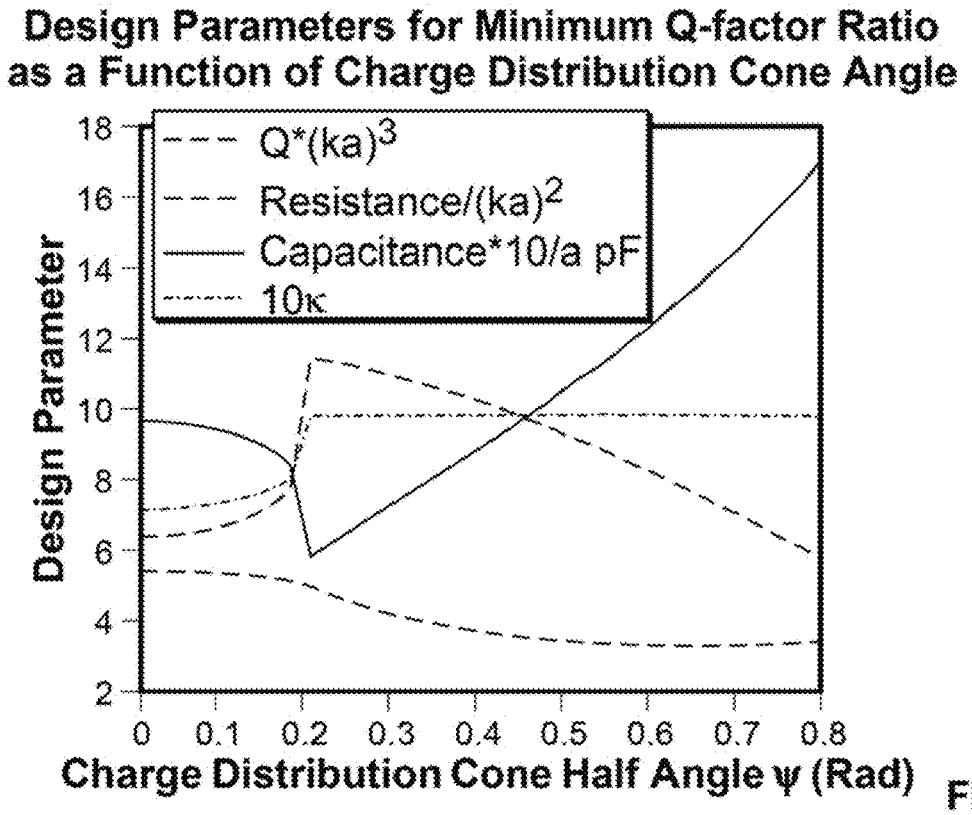
FIG. 8 plots the minimum Q-factor ratio, $Q(ka)^3$, as a function of ψ in radians; the capacitance, C/a; radiation resistance, $R_{rad}/(ka)^2$.

FIG. 8 plots the minimum Q-factor ratio, $Q(ka)^3$, as a function of ψ in radians; the capacitance, C/a; radiation resistance, $R_{rad}(ka)_2$; and 10κ for this solution are also plotted. At the discontinuity, Q-factor ratio has the same values at two points with different values of κ. Below the discontinuity, the increasing κ in turn increases $R_{rad}/(ka)^2$ and also increases the scalar potential on the sphere; this reduces the capacitance of the antenna. Above the discontinuity, κ is almost constant $R_{rad}/(ka)^2$ decreases with the $\cos^2\psi$. The capacitance increases with the charge-distribution cone-half angle ψ. The surface charge density is spread over a much large area; this reduces the peak scalar potential on the enclosing sphere and increases the capacitance. For ψ>0.177, the minimum Q-factor antenna no longer touches top of the enclosing sphere. For charge-cone-half angles 0.24≤ψ≤0.71 range, κ is constant.

Figure 9:
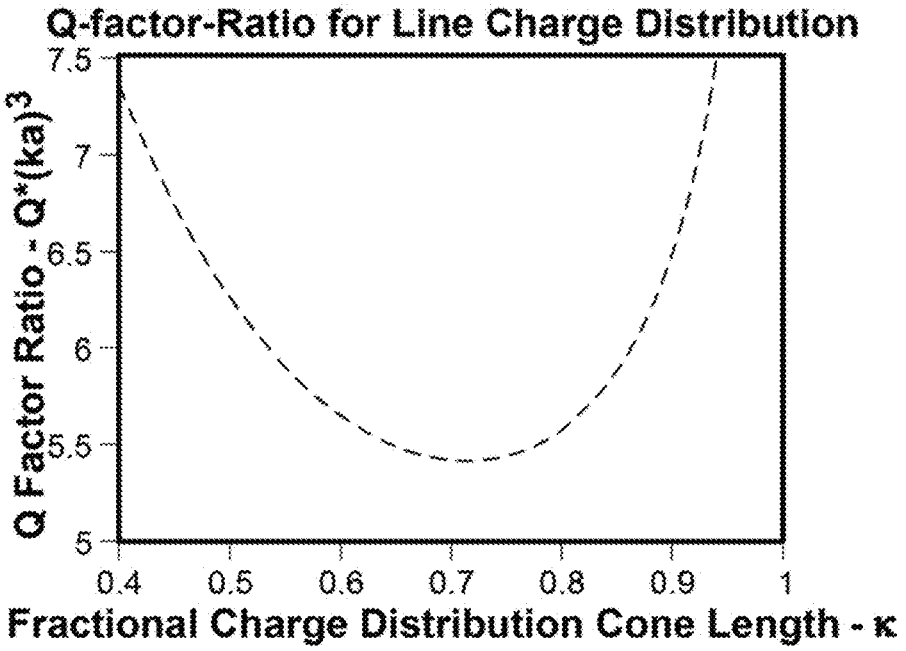
FIG. 9 plots the line charge distribution Q-factor-ratio design curve as a function of κ.
Figure 10:
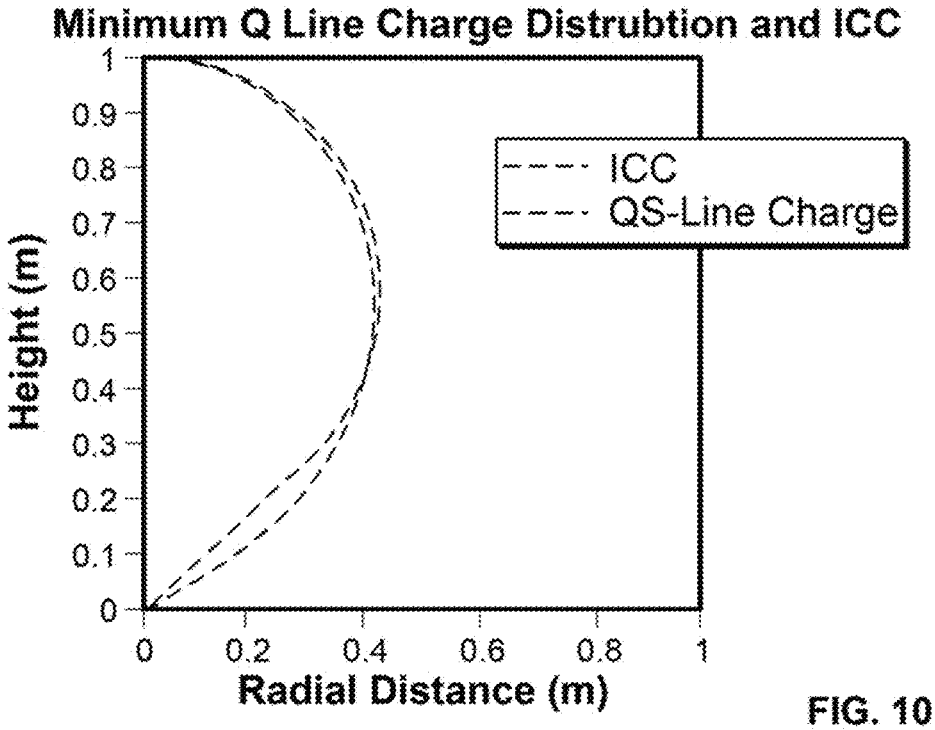
FIG. 10 plots the antenna shape for the ICC antenna and the minimum Q-factor-ratio line charge distribution design.

The first row in Table 1 is the minimum Q-factor ratio for the line charge distribution. FIG. 9 plots the line charge distribution Q-factor-ratio design curve as a function of κ. FIG. 10 plots the antenna shape for the ICC antenna and the minimum Q-factor-ratio line charge distribution design. The line charge distribution bulb shape is almost the same as the ICC antenna; but, ICC feed point cone is much smaller. The 50Ω input impedance ICC antenna will be used as the best existing solution. In the prior art, an ICC antenna has not been evaluated for different cone half angles; the 50Ω input impedance ICC antenna may not be the minimum Q-factor solution.

Table 1 below describes antenna design parameters, radiation resistance/$(ka)^2$, capacitance and Q-factor ratio.

TABLE 1

| | ψ | κ | $R_{Rad}/(ka)^2$ | C/a | Q $(ka)^3$ |
|---|---|---|---|---|---|
| Line Charge | 0 | 0.7150 | 6.3747 | 96.6077 ρF | 5.413 |
| Max $R_{Rad}$ | 0.19481 | 0.9789 | 11.5 | 57.45 ρF | 5.045 |
| 50 Ω | 0.3408 | 0.940 | 9.7871 | 84.9754 ρF | 4.008 |
| 30 Ω | 0.5296 | 0.8711 | 7.047 | 127.805 ρF | 3.701 |
| Min. Q factor ratio 32 Ω | 0.653 | 0.9809 | 7.5688 | 134.890 ρF | 3.265 |

Figure 11:
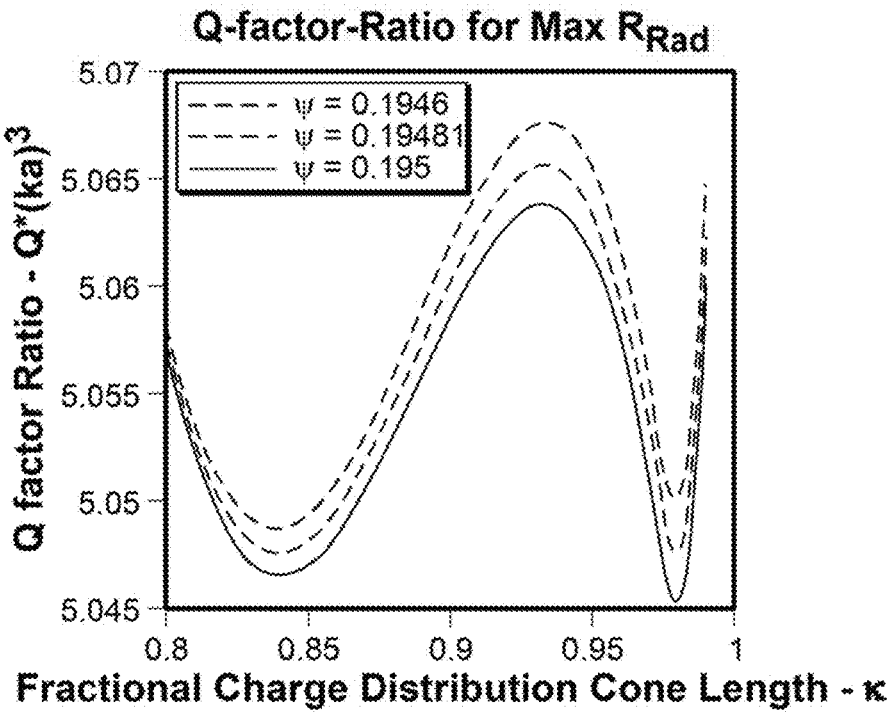
FIG. 11 plots Q-factor-ratio design curves for ψ=0.1946, ψ=0.19481 and ψ=0.195.

The second row in Table 1 is the maximum resistance design. FIG. 11 plots Q-factor-ratio design curves for ψ=0.1946, ψ=0.19481 and ψ=0.195. The minimum Q shifts from κ~0.84 on the ψ=0.1946 design curve to κ~0.98 on the ψ=0.195 design curve. The design curve for ψ=0.19481 has two equal minimum Q-factor-ratios. The maximum $R_{Rad}$ design does not give a significant decrease in Q-factor ratio and will not be numerically modeled.

Figure 12:
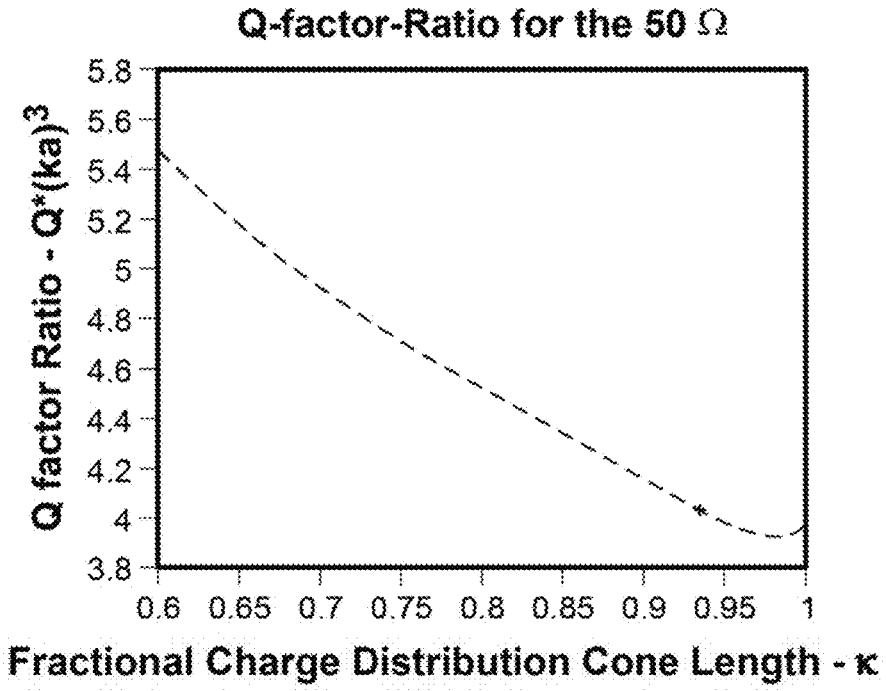
FIG. 12 shows, for the 50Ω input impedance design curve, the minimum Q-factor ratio and the position of the design.
Figure 13:
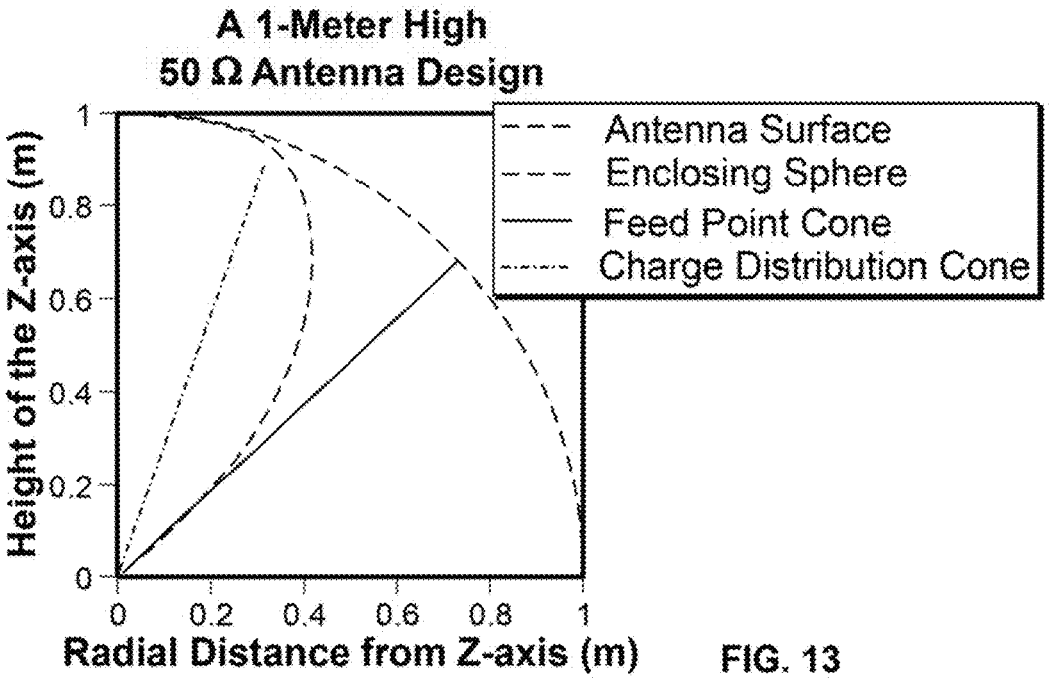
FIG. 13 is the 50Ω input impedance design cross section that fills the top of a sphere.
Figure 14:
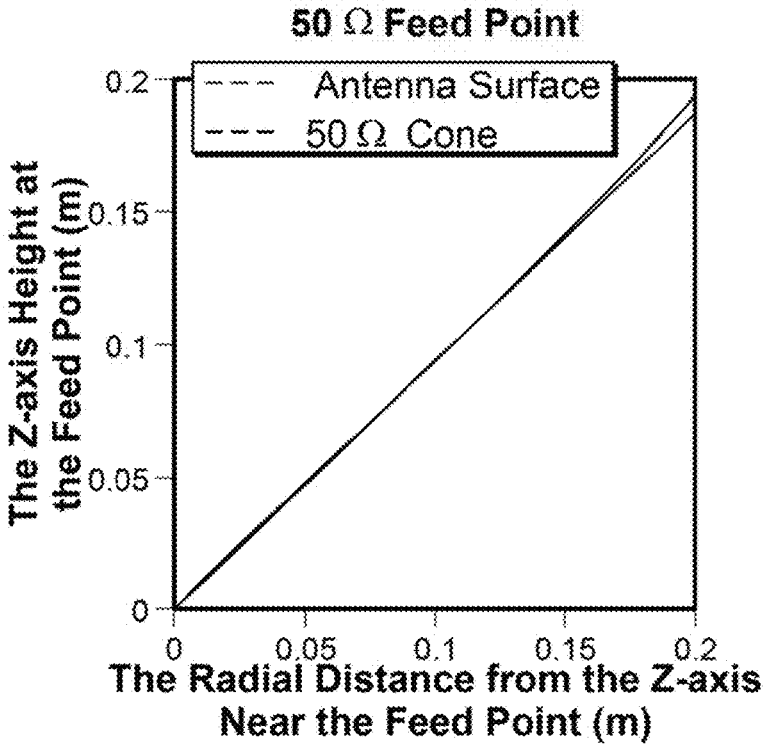
FIG. 14 shows that the antenna design is a very good approximation of the 50Ω input impedance cone.

The third row in Table 1 is 50Ω input impedance design. The parameters are selected to touch the enclosing sphere at the top. The 50Ω input impedance design curve, FIG. 12, shows the minimum Q-factor ratio and the position of the design. FIG. 13 is the 50Ω input impedance design cross section that fills the top of the sphere. FIG. 14 shows that the antenna design is a very good approximation of the 50Ω input impedance cone.

Figure 15:
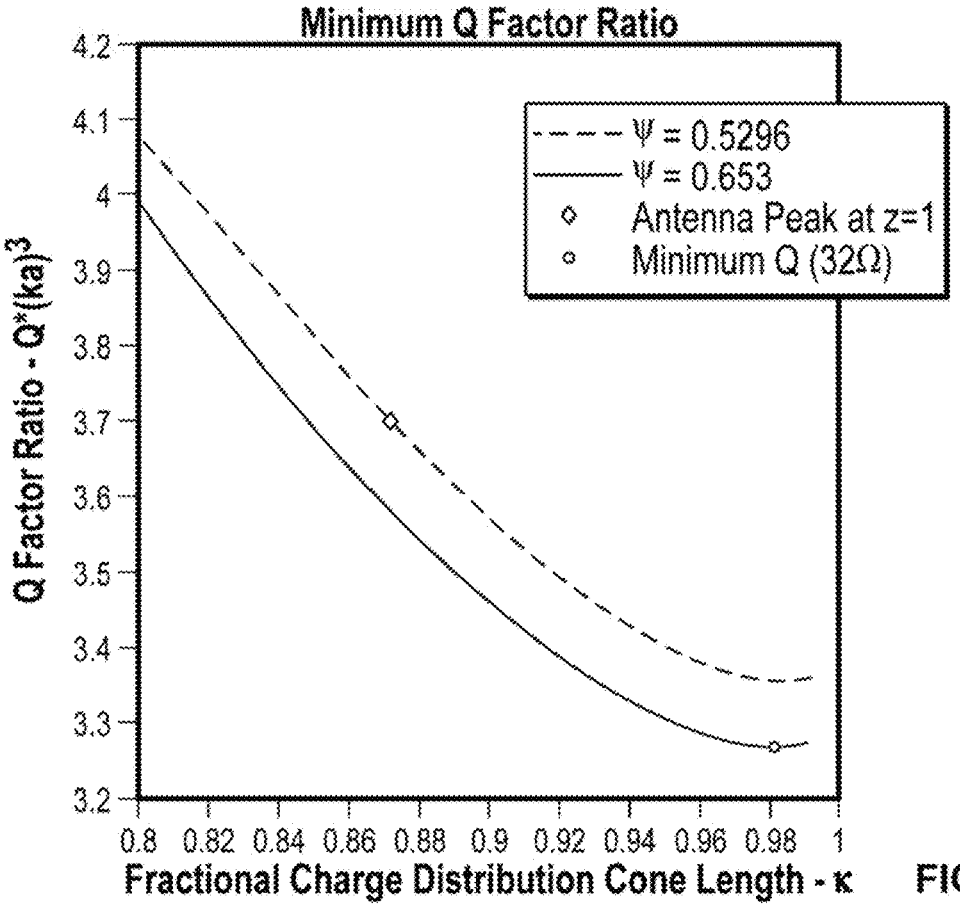
FIG. 15 shows the two design curves for fixed ψ=0.5296 and ψ=0.653.
Figure 16:
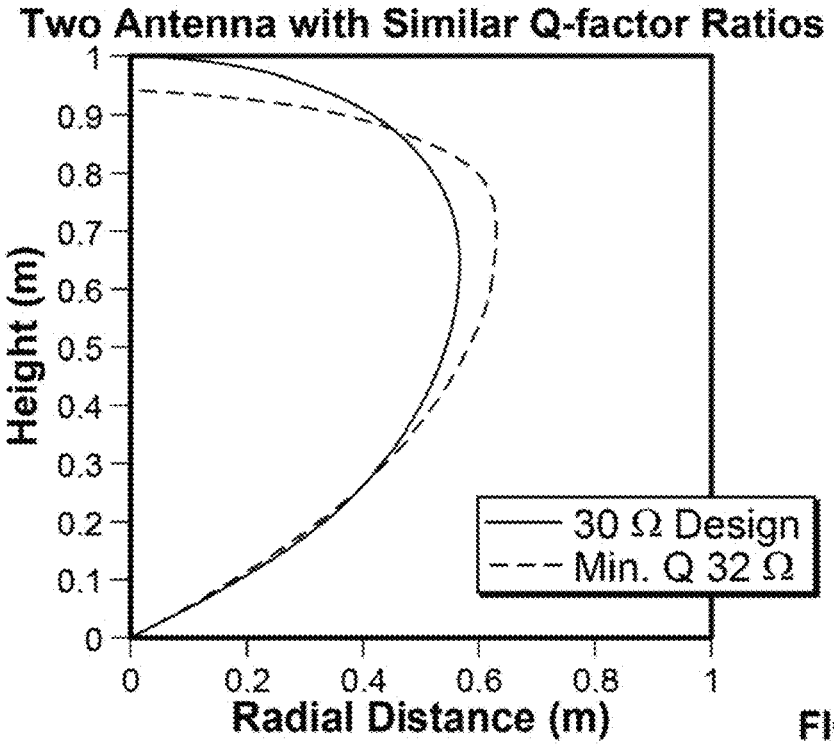
FIG. 16 shows the two design curves for similar Q-factor ratios.

The last two rows in Table 1 have similar input impedance but very different shapes. A 30Ω input impedance design touches the top of the enclosing sphere. On the other hand, the 32Ω minimum Q-factor-ratio design touches the side of the enclosing sphere. FIG. 15 shows the two design curves for fixed ψ=0.5296 and ψ=0.653. FIG. 16 shows there is a significant difference in the antenna shape. The next section shows that the 32Ω input impedance design reduces the lowest operational frequency without increasing the VSWR at higher frequencies.

Numerical results will now be described.

The numerical results are calculated with the T-solver in Computer Simulation Technology (CST) Microwave Studio. The numerical model uses a coaxial cable (source) embedded in a thin cone 6 mm high with a diameter of 400 mm on the ground plane. For the 50Ω coaxial source, the inner conductor is 6 mm radius wire and the outer conductor is 13.8 mm in radius. Air is the insulator between the conductors. The coaxial inner conductor extends into the body of the antenna replacing the point of the cone with a cylinder. The problem size is reduced by using $B_{\|}=0$ on the x-z and y-z symmetry plane. Energy adaptation was used to obtain a series of mesh refinements. In the initial work, the antennas were selected to touch the top of the sphere, ρ=0 and z=1.

Figure 17:
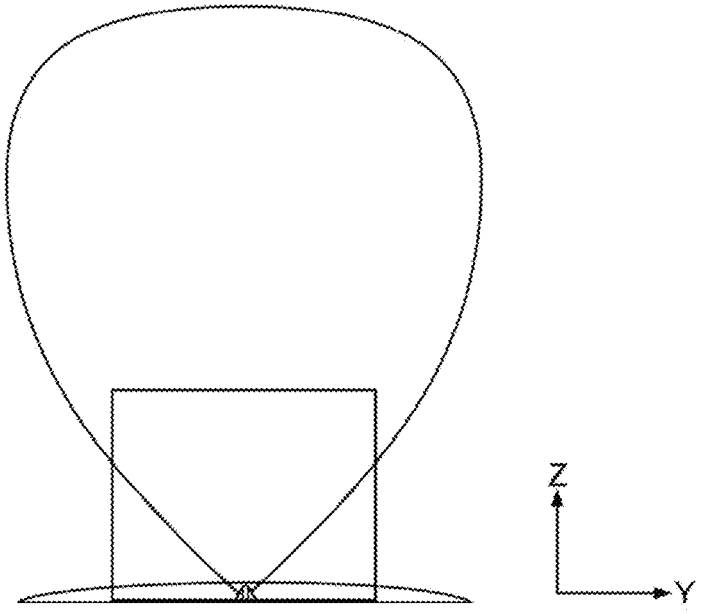
FIG. 17 is the cross section of the Computer Simulation Technology (CST) antenna model for the 50Ω input impedance antenna.
Figure 18:
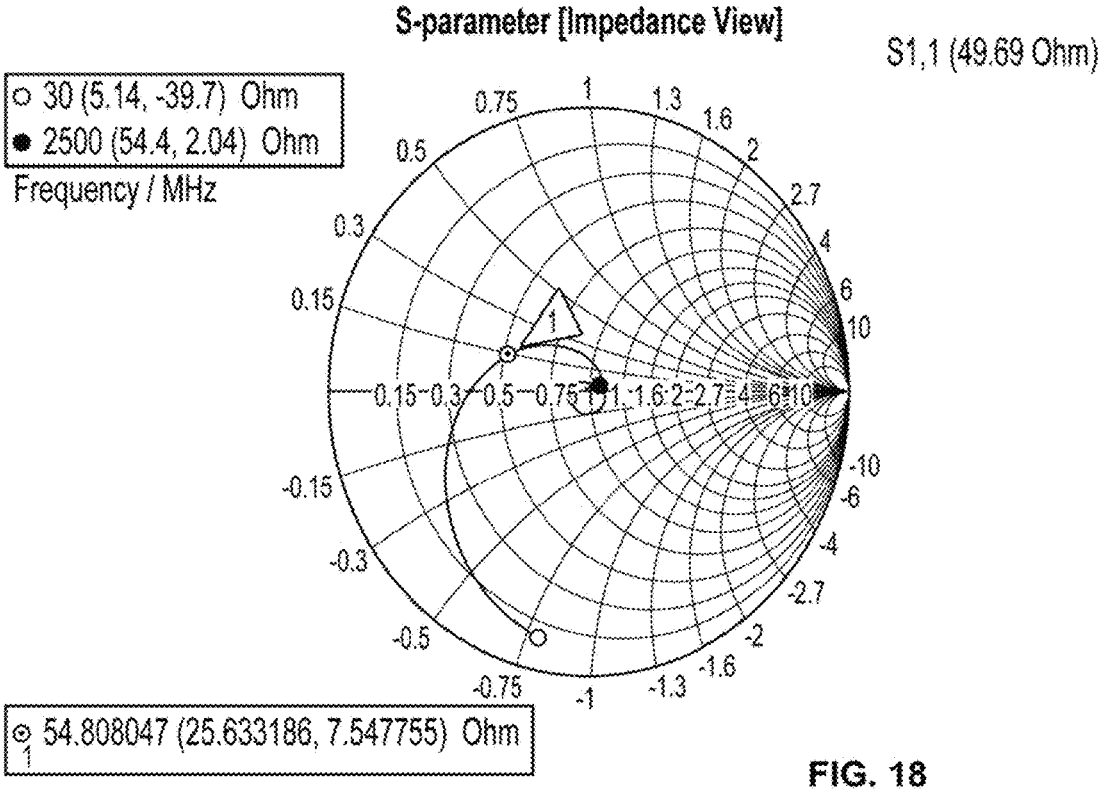
FIG. 18 is the Smith chart for the frequency range 30 MHz to 2.5 GHz.
Figure 19:
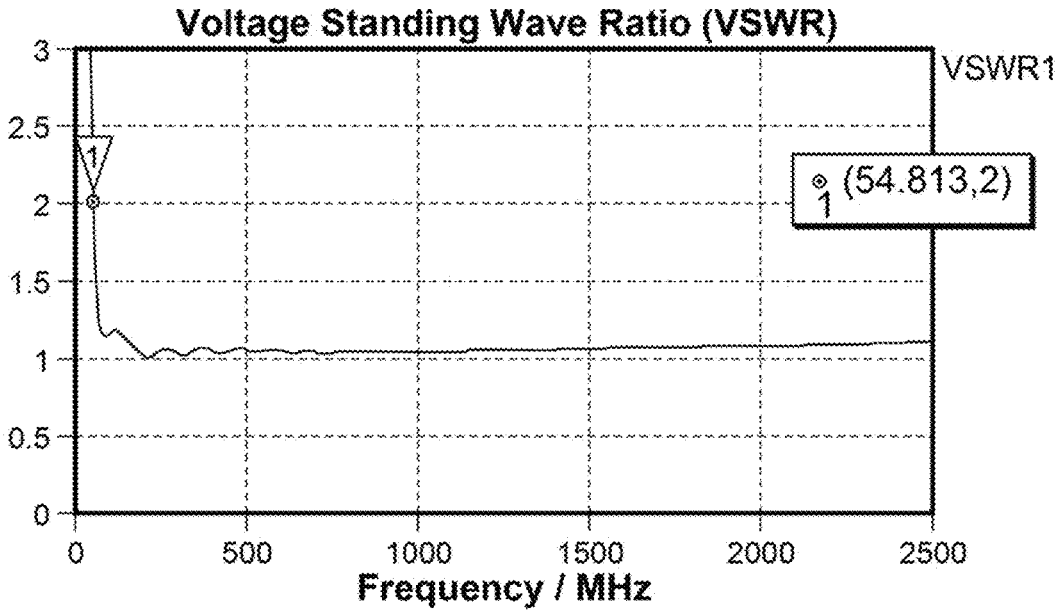
FIG. 19 is the VSWR plot for the frequency range 30 MHz to 2.5 GHz.

FIG. 17 is the cross section of the CST antenna model for the 50Ω input impedance antenna. FIG. 18 is the Smith chart and FIG. 19 is the VSWR plot for the frequency range 30 MHz to 2.5 GHz. The VSWR is 2:1 at 54.813 MHz; this is an 8.6% reduction in size compared to the results of prior art systems. The VSWR is less than 1.2 for most of the frequency range. This is an unexpected result.

The Q-factor and lowest operating frequency can be reduced by increasing charge-distribution-cone half angle ψ; this lowers the impedance of the feed-point cone and increases the capacitance. The numerical model uses a 30Ω coaxial source embedded in a thin-cone 3 mm high with a diameter of 400 mm on the ground plane. For the 30Ω coaxial source, the inner conductor is 3 mm in radius wire and the outer conductor is 5.001 mm in radius. Air is the insulator between the conductors. The coaxial inner conductor extends into the body of the antenna replacing the point of the cone with a cylinder. Energy adaptation was used to obtain a series of mesh sizes. This antennas were touches the top of the sphere, ρ=0 and z=1.

Figure 20:
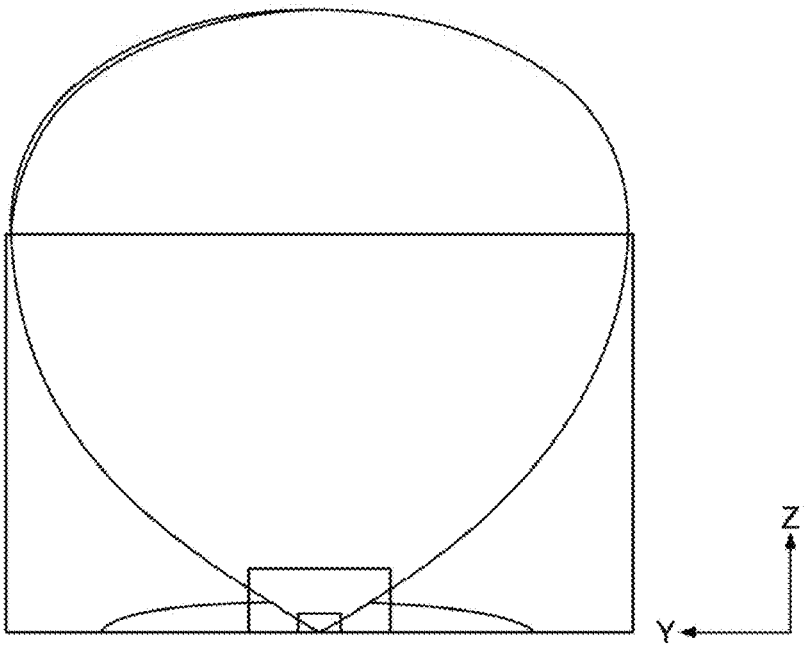
FIG. 20 is the cross section of the CST antenna model for the 30Ω input impedance antenna.
Figure 21:
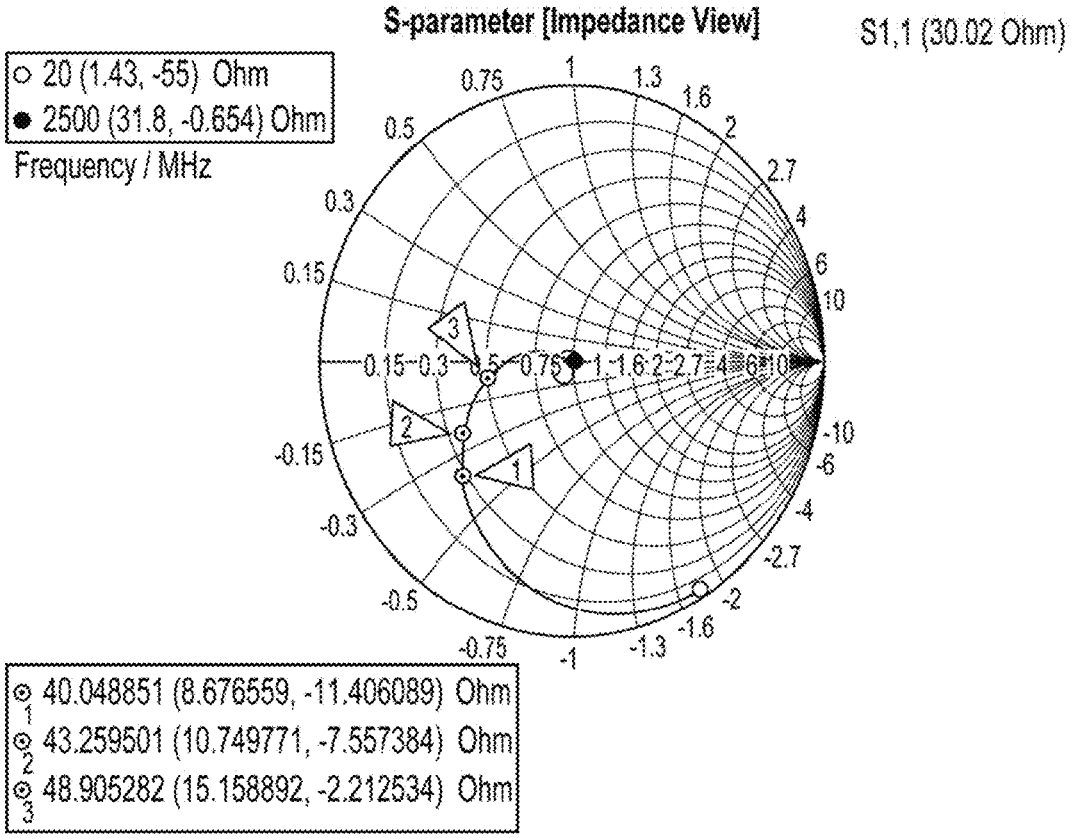
FIG. 21 is the Smith chart for the frequency range 20 MHz to 2.5 GHz.
Figure 22:
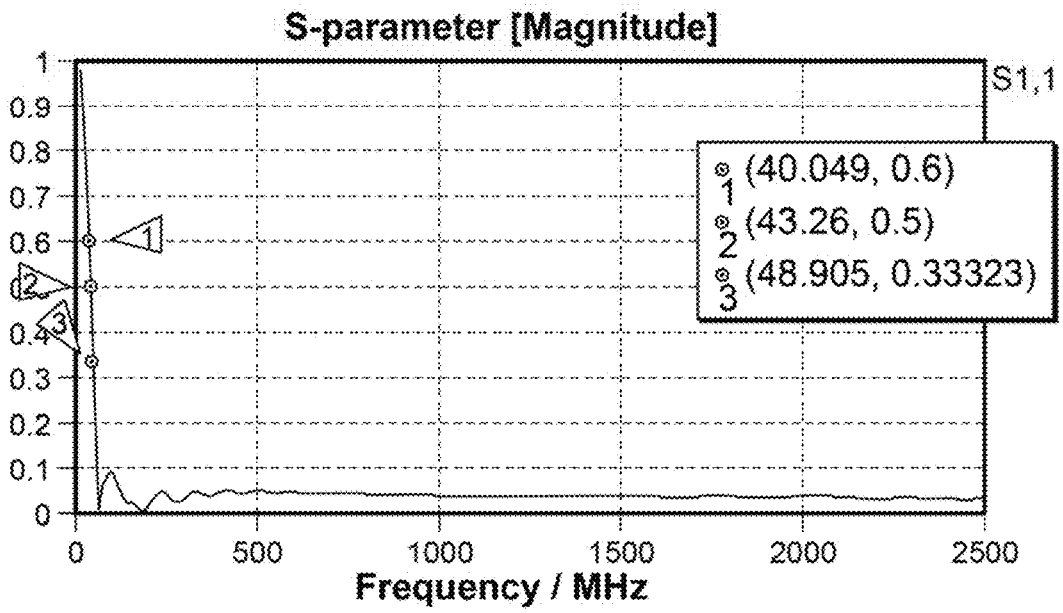
FIG. 22 is the magnitude of the reflection coefficient, F, for the frequency range 20 MHz to 2.5 GHz.
Figure 23:
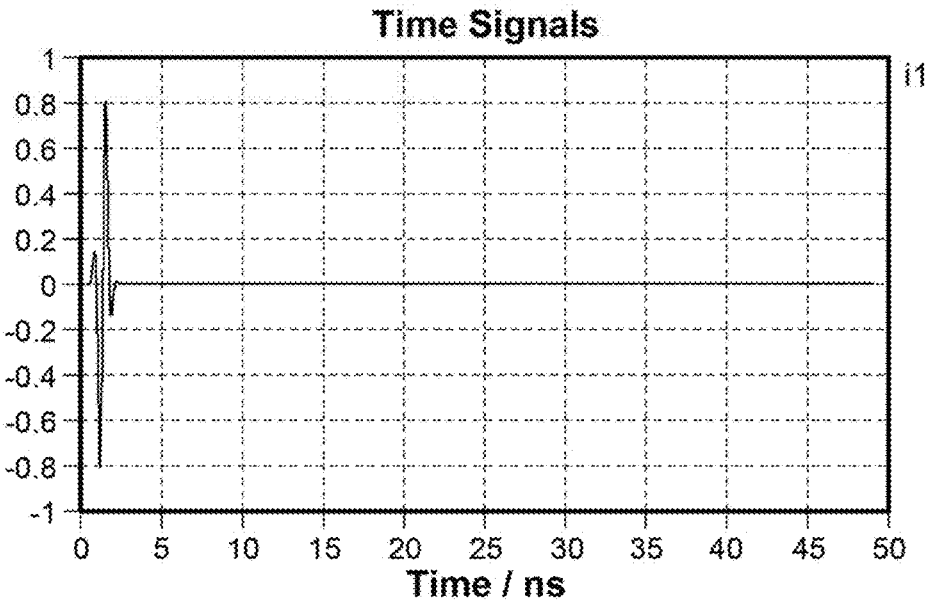
FIG. 23 is the CST source impulse.
Figure 24:
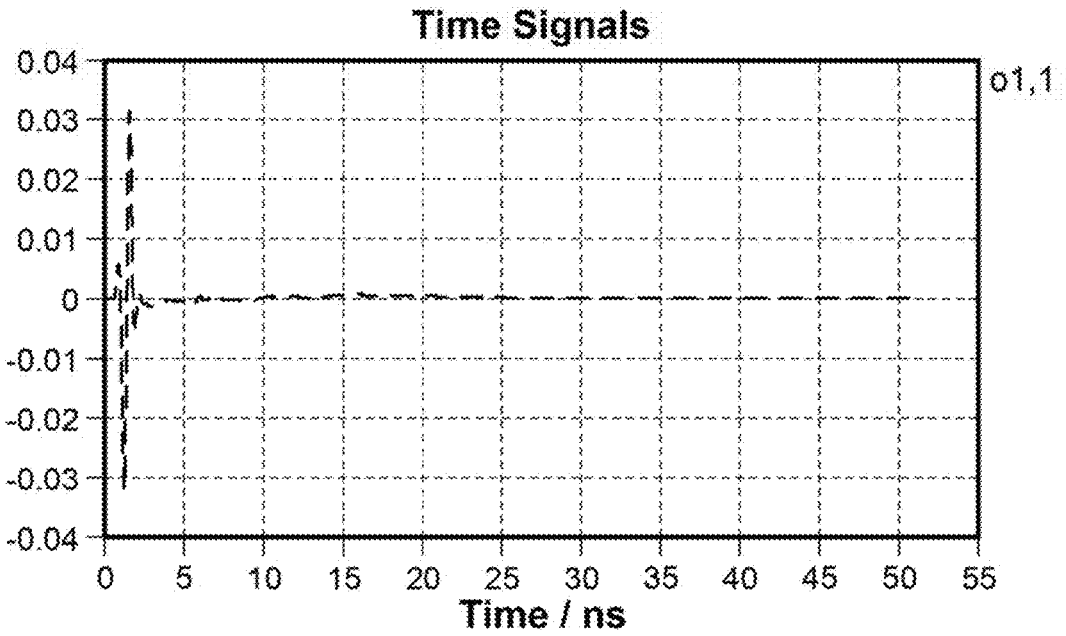
FIG. 24 is the CST reflected impulse.

FIG. 20 is the cross section of the CST antenna model for the 30Ω input impedance antenna. FIG. 21 is the Smith chart and FIG. 22 is the magnitude of the reflection coefficient, Γ, for the frequency range 20 MHz to 2.5 GHz. The VSWR is 2:1 at 48.9 MHz or λ/6.134. This is almost a 18.5% reduction in size compared to a prior art design. The reflection coefficient ranges from 1/10 to 1/20 for almost of the frequency range. (VSWR 1.2 to 1.1) FIG. 23 is the CST source impulse and FIG. 24 is the CST reflected impulse. It should be noted that the scale on the reflected pulse is 3% of source impulse. At the feed point, the reflection is 3.75% of the incident pulse.

Figure 25:
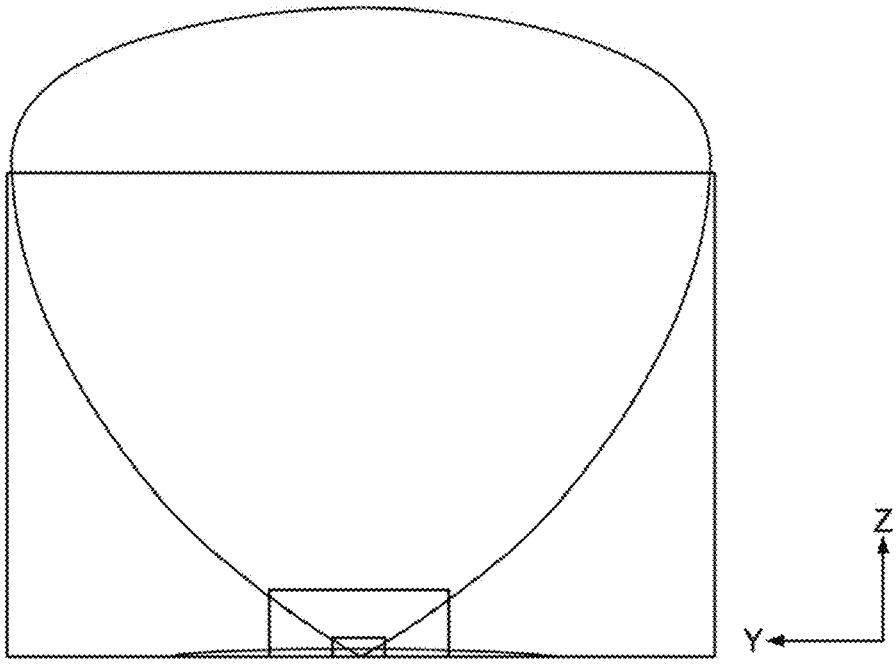
FIG. 25 is the cross section of the CST antenna model for the 32Ω input impedance antenna.
Figure 26:
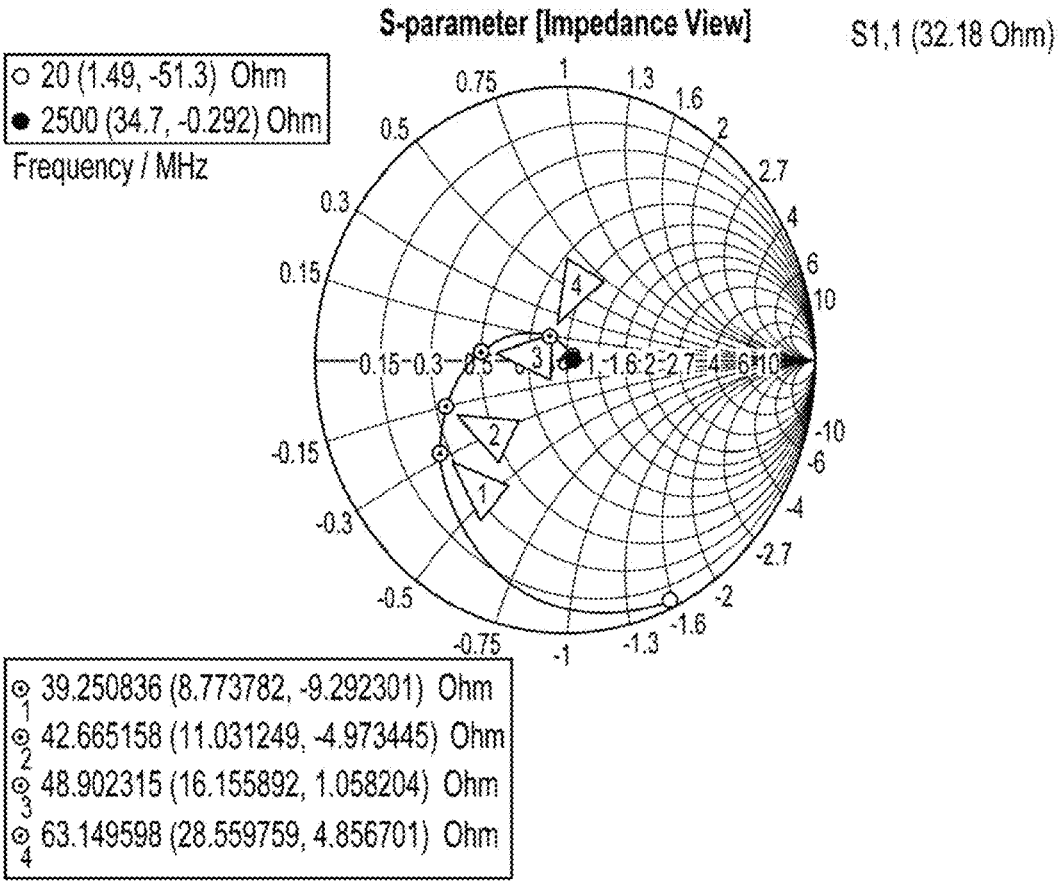
FIG. 26 is the Smith chart for the frequency range 20 MHz to 2.5 GHz.
Figure 27:
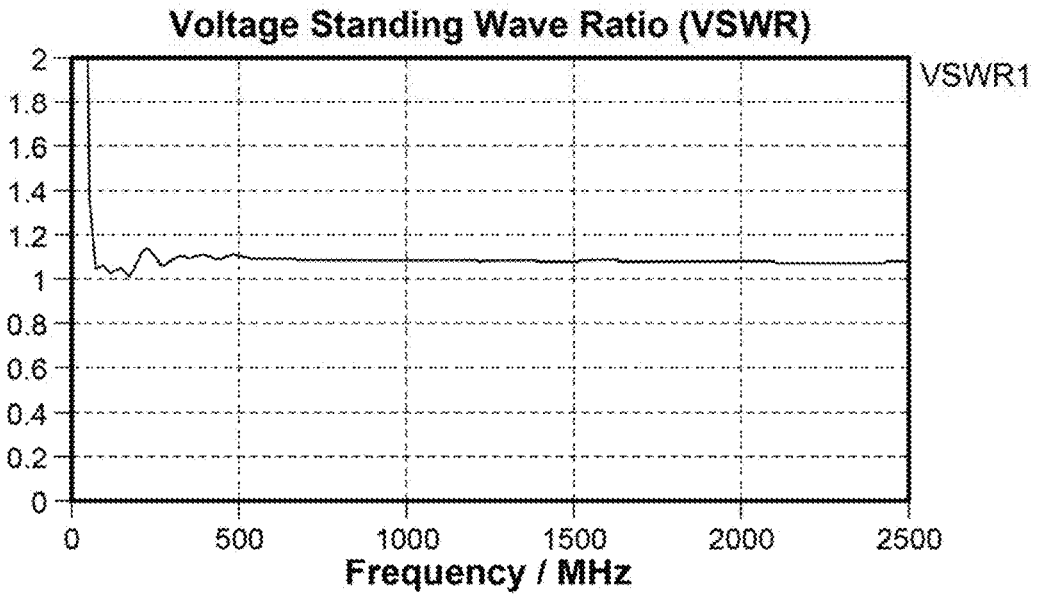
FIG. 27 is the VSWR plot for the frequency range 20 MHz to 2.5 GHz.
Figure 28:
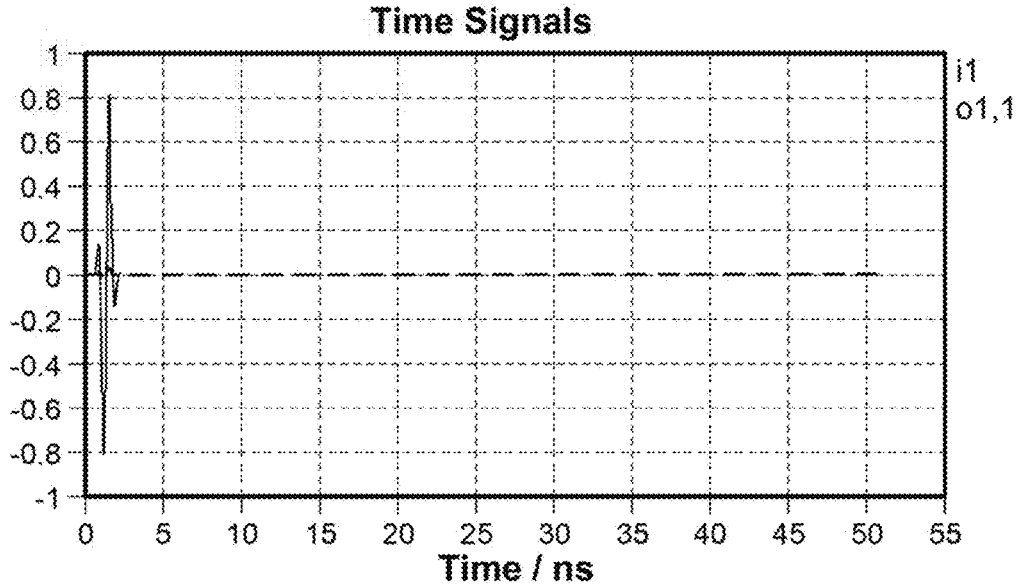
FIG. 28 is the CST source pulse.
Figure 29:
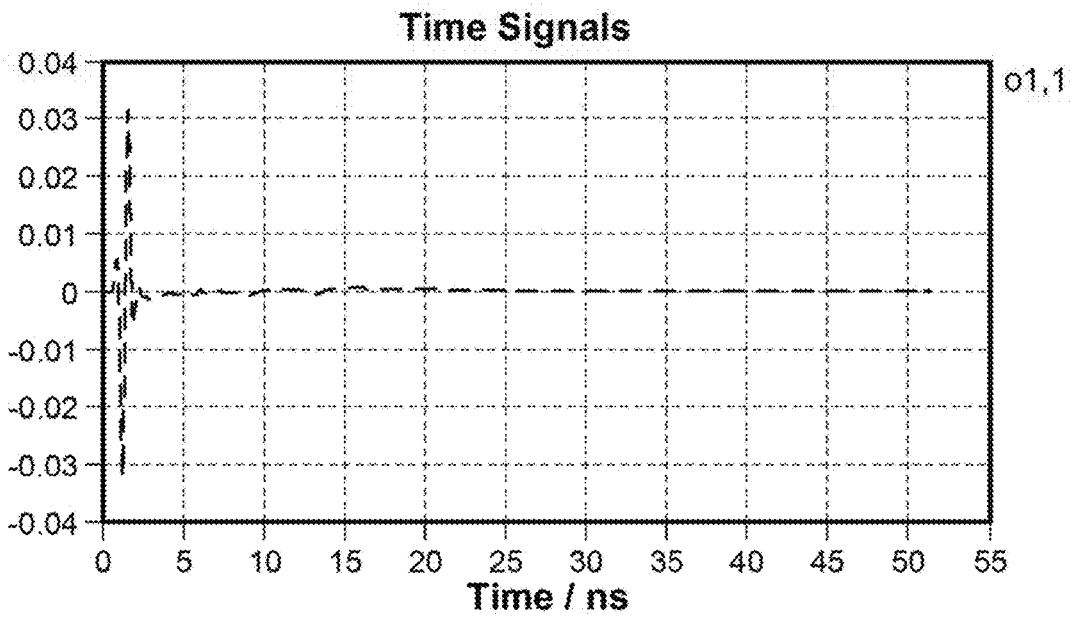
FIG. 29 is the CST reflected pulse.

The final design places no restriction on the antenna shape. The top of the antenna no longer touches the top of the sphere. FIG. 25 is the cross section of the CST antenna model for the 32Ω input impedance antenna. FIG. 26 is the Smith chart and FIG. 27 is the VSWR plot for the frequency range 20 MHz to 2.5 GHz. The VSWR is 2:1 at 48.9 MHz; this is the slightly larger than the previous result. FIGS. 28 and 29 are the CST source and reflected pulse. In FIG. 16, the minimum Q antenna design has a rapid change in slope near the enclosing sphere; one would expect RF to be reflected from this region. The RF is not reflected. This implies that other changes in shape can be made without increasing the VSWR. The antennas capacitance and radiation resistance can both be increased and Q-factor decreased by filling the top of the sphere. A more complex charge distribution models can be used to extend the cone length, fill the top of the sphere and significantly reduce the Q-factor.

Table 2 below describes the lowest operating frequency for different VSWRs.

TABLE 2

| Design | Q * (ka)$^3$ | ρ = 1/3 | 2:1 VSWR | 3:1 VSWR | 4:1 VSWR |
|---|---|---|---|---|---|
| 50 Ω | 4.008 | 1.149 ka | 54.81 MHz | 47.18 MHz | 43.08 MHz |
| 30 Ω | 3.701 | 1.006 ka | 48.005 MHz | 43.23 MHz | 40.05 MHz |
| Min. Q factor ratio 32 Ω | 3.265 | 1.025 ka | 48.90 MHz | 42.67 MHz | 39.25 MHz |

Table 2 summarizes the VSWR numbers for the three designs. The frequencies for 3 to 1 and 4 to 1 VSWR are steadily decreasing with lower Q. Those of skill in the art may calculate the smallest possible ka value for the UWB antenna size and VSWR. This analytic solution assumes a dipole mode with an infinite lossless matching network. The UWB antenna size is ka≥0.46833 or $a=\lambda_{max}/13.4$ for a 3:1 VSWR. They pointed out that an antenna can be "pre-tuned" and not require a matching network. Their derivation does not indicate the size of a "pre-tuned" antenna. A prior art antenna has been designed with a 10 to 1 bandwidth and an antenna size $a=\lambda_{max}/8$.

The Q for a fat dipole can be minimized with the QADA. The Q calculation is valid at low frequencies, such as those below resonance. A low Q antenna shape allows energy to easily radiate from the antenna. In addition, the shape of the fat dipole bulb nicely approximates a cone at the feed point. Modifying the feed point conical shape will give an UWB antenna. The reduction in performance is modest.

The low Q bulb shape allows the UWB antenna to radiate better at low frequencies.

This concept can be implemented in another way. The enclosing surface for the fat dipole can be limited to a conical surface, a cone apex at the feed point. The charge distribution will be a linear combination of $P_1, P_3, P_5, \ldots, P_{2n+1}$, where n is an integer. The charge distribution cone half angle needs to be varied to achieve the minimum Q design. This solution will have a lower Q than the solution mentioned above. This approach allows the cone angle to be fixed.

This concept can be implemented in another way. The fat dipole can be limited to a conical surface, a cone apex at the feed point. The charge distribution on each arm will be a linear combination of $P_1, P_2, P_3, \ldots, P_n$, where n is an integer. The charge distribution cone half angle needs to be varied to achieve the minimum Q design. This solution will have a lower Q than the solution mentioned above. The Q error introduced by the cone approximation will be smaller.

The cone angle determines the antenna impedance and antenna pattern at high frequencies.

In other embodiments, a top load charge basis functions may be added to the antenna design. Further, in some embodiments, other charge basis functions may be used to model the charge distribution. Major changes to the low Q bulb shape may additionally occur. In some embodiments, the cone may not be tangential to the bulb. Further, a dimple at the top of the antenna may be replaced with a spherical cap.

Example embodiments drawn to toploads for the cone will now be discussed.

The edge of the cone can have a ring of charge γ with a radius ρ=κa sin(ψ) and a height z=κa cos(ψ) or a point charge with a height=κa cos(ψ). This matches the ring to the end of the cone. An alternative is the disk charge distribution. In both cases, the effective height is $$h_{Eff}^{TL}(\kappa, \psi) = \left[(1-\alpha-\gamma)\frac{\kappa a}{2} + \alpha\frac{2\kappa a}{3} + \gamma\kappa a\right]\cos(\psi) \tag{34}$$

Where γ is the fraction of charge on the topload. In the general case, other radius and height values can be used for the top load. The top load does not need to match the top of the cone. The calculation of the effective height is known to those of skill in the art.

The quasi-static antenna design algorithm (QADA) is a physics based approach for UWB antenna designs. The cone with a bulb shape is used as a UWB antenna model. Minimizing the Q-factor ratio for this model yields cone and bulb shapes with improved the low frequency performance. The lowest Q-factor ratio is a 32Ω input impedance UWB antenna that fills most of the enclosing sphere's volume. The 30Ω input impedance and minimum Q-factor ratio designs have very different shapes with similar Q-factor ratios and very low VSWR. The shape difference should reflect RF back to the feed point. This is an unexpected result. One would expect the VSWR to increase as the operating frequency is reduced. The lowest operating frequency of the UWB antenna should give a uniform VSWR over the entire band. Any further reducing in operating frequency would reduce the antenna band width.

The above model uses a linear charge distribution on the cone. The QADA can use a sequence of more complex charge distribution models: quadratic, cubic, etc. on the cone. Each new charge distribution should extend the length on the cone and the size of the bulb. This moves the charge distribution to a high position on the antenna, increasing the effective height and radiation resistance. The larger cone and bulb will also reduce the surface-charge density on the antenna; this reduces the electric field around the antenna. Both factors reduced the Q. Each minimum Q-factor design requires numerical modeling to evaluate the impedance and the VSWR. The quasistatic antenna design algorithm will reduce the lowest operating frequency of the antenna; however, the new antenna shape could adversely impact the high frequency response of the antenna. The Q-factor design curves allow the antenna shape to be modified by selecting a new design near the minimum Q-factor ratio. This could round the bulb shape and reduce VSWR. The quasistatic antenna design algorithm should be able to design significantly smaller UWB antennas.

The foregoing description of various preferred embodiments have been presented for purposes of illustration and description. It is not intended to be exhaustive or to limit the invention to the precise forms disclosed, and obviously many modifications and variations are possible in light of the above teaching. The example embodiments, as described above, were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed as new and desired to be protected by Letters Patent of the United States is:

1. A method for designing an ultra-wide band conical antenna comprising:

choosing a charge distribution cone angle, ψ, for the predetermined input feed resistance;

choosing a length of a charge distribution, κ;

determining desired values for resistance, capacitance and Q-factor via a quasistatic antenna design algorithm based on ψ and κ; and selecting an ultra-wide band conical antenna design having a bulb shape with a conical feed point, from among a set of antenna designs that produces the desired values for resistance, capacitance and Q-factor.

2. The method of claim 1, wherein said choosing a charge distribution cone angle ψ, comprises choosing a linear charge distribution on the cone.

3. The method of claim 1, wherein said choosing a charge distribution cone angle ψ, comprises choosing a non-linear charge distribution on the cone.

4. The method of claim 1, wherein the ultra-wide band conical antenna design having a bulb shape with a conical feed point is selected from a set of antenna designs with a local minimized Q-factor.

5. The method of claim 1, wherein said selecting an ultra-wide band conical antenna design having a bulb shape with a conical feed point, is from a set of antenna designs with a predetermined resistance and minimized Q-factor.

6. The method of claim 1, wherein said selecting an ultra-wide band conical antenna design having a bulb shape with a conical feed point, is from a set of antenna designs with a predetermined capacitance and minimized Q-factor.

7. The method of claim 1, wherein said selecting an ultra-wide band conical antenna design having a bulb shape with a conical feed point, is from a set of antenna designs with a predetermined resistance and capacitance.

8. An ultra-wide band conical antenna having a bulb shape with a conical feed point having a predetermined input feed resistance, comprising:

a conical feed point having a cone angle and a length and a predetermined input feed resistance; and a bulb shape disposed on said conical feed point, and wherein said conical feed point is operable to distribute charge in a charge distribution cone angle, ψ, corresponding to the cone angle and to distribute charge in charge distribution length, κ, corresponding to the length for the predetermined input feed resistance, and wherein said conical feed point and said bulb shape have a desired value for resistance, capacitance and Q-factor via as determined by a quasistatic antenna design algorithm based on ψ and κ.

9. The ultra-wide band conical antenna of claim 8, wherein the charge distribution cone angle ψ, comprises a linear charge distribution on the cone.

10. The ultra-wide band conical antenna of claim 9, wherein said selecting an ultra-wide band conical antenna design having a bulb shape with a conical feed point, from among the set of ultra-wide band conical antenna designs having a bulb shape with a conical feed point, that produces the desired resistance, and a minimized Q-factor.

11. The ultra-wide band conical antenna of claim 10, wherein the predetermined input feed resistance is selected from the group consisting of 30 ohms, 32 ohms and 50 ohms.

12. The ultra-wide band conical antenna of claim 8, wherein the charge distribution cone angle ψ is a non-constant function of a height of the charge distribution.

13. The ultra-wide band conical antenna of claim 12, wherein the charge distribution is a linear function of the charge distribution height.

14. The ultra-wide band conical antenna of claim 13, wherein the predetermined input feed resistance comprises one of a group consisting of 30 ohms, 32 ohms and 50 ohms.

15. The ultra-wide band conical antenna of claim 12, wherein the charge distribution is a piece-wise constant function of the charge distribution height.

16. The ultra-wide band conical antenna of claim 12, wherein the charge distribution is a higher order polynomial charge distribution on the cone.

17. The ultra-wide band conical antenna of claim 12, wherein the ultra-wide band conical antenna having the bulb shape with the conical feed point is selected from among a set of ultra-wide band conical antenna designs having multiple different bulb shapes, that produces a desired resistance and a minimized Q-factor.

18. The ultra-wide band conical antenna of claim 17, wherein the predetermined input feed resistance is selected from the group consisting of 30 ohms, 32 ohms and 50 ohms.

19. The ultra-wide band conical antenna of claim 8, wherein the ultra-wide band conical antenna having the bulb shape with the conical feed point is selected from among a set of ultra-wide band conical antenna designs having multiple different bulb shapes.

20. An ultra-wide band conical antenna having a bulb shape with a conical feed point having a predetermined input feed resistance, comprising:

a conical feed point having a cone angle, a length and a predetermined input feed resistance; and a bulb shape disposed on said conical feed point, wherein said conical feed point and said bulb shape have a resistance, desired capacitance and a minimized Q-factor as determined by a quasistatic antenna design algorithm based on ψ and κ, wherein ψ is a charge distribution cone angle, wherein κ is a charge distribution length, and wherein the predetermined input feed resistance comprises one of the group consisting of 30, 32, and 50 ohms such that the ultra-wide band conical antenna's shape is generated by a cylindrically-symmetric charge distribution.

* * * * *